US010638243B2

(12) United States Patent
Beack et al.

(10) Patent No.: US 10,638,243 B2
(45) **Date of Patent: *Apr. 28, 2020**

(54) MULTICHANNEL SIGNAL PROCESSING METHOD, AND MULTICHANNEL SIGNAL PROCESSING APPARATUS FOR PERFORMING THE METHOD

(71) Applicant: Electronics and Telecommunications Research Institute, Daejeon (KR)

(72) Inventors: Seung Kwon Beack, Daejeon (KR); Jeong Il Seo, Daejeon (KR); Jong Mo Sung, Daejeon (KR); Tae Jin Lee, Daejeon (KR); Dae Young Jang, Daejeon (KR); Jin Soo Choi, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/290,469

(22) Filed: Mar. 1, 2019

(65) Prior Publication Data

US 2019/0200150 A1 Jun. 27, 2019

Related U.S. Application Data

(63) Continuation of application No. 15/551,734, filed as application No. PCT/KR2016/001613 on Feb. 17, 2016, now Pat. No. 10,225,675.

(30) Foreign Application Priority Data

Feb. 17, 2015 (KR) ..... 10-2015-0024464
Feb. 17, 2016 (KR) ..... 10-2016-0018462

(51) Int. Cl.
*H04S 1/00* (2006.01)
*H04S 3/00* (2006.01)
(Continued)

(52) U.S. Cl.
CPC ..... *H04S 1/007* (2013.01); *G10L 19/008* (2013.01); *H04S 3/008* (2013.01); *H04S 5/00* (2013.01);
(Continued)

(58) Field of Classification Search
CPC . H04S 1/007; H04S 3/008; H04S 5/00; H04S 3/02; H04S 2400/01;
(Continued)

(56) References Cited

U.S. PATENT DOCUMENTS

2007/0233293 A1 10/2007 Villemoes et al.
2010/0228554 A1 9/2010 Beack et al.
(Continued)

FOREIGN PATENT DOCUMENTS

EP 2 880 053 A1 1/2015
EP 3 023 984 A1 5/2016
(Continued)

OTHER PUBLICATIONS

Dolby Laboratories, Inc., "Dolby Metadata Guide," Issue 3, 2005 (retrieved from http://www.dolby.com/us/en/technologies/doby-metadata.html) (28 pages in English).
(Continued)

*Primary Examiner* — David L Ton
(74) *Attorney, Agent, or Firm* — NSIP Law

(57) ABSTRACT

Provided are an encoding method of a multichannel signal, an encoding apparatus to perform the encoding method, a multichannel signal processing method, and a decoding apparatus to perform the decoding method. The decoding method may include identifying an N/2-channel downmix signal derived from an N-channel input signal; and generating an N-channel output signal from the identified N/2-channel downmix signal using a plurality of one-to-two (OTT) boxes. If a low frequency effect (LFE) channel is
(Continued)

absent in the output signal, the number of OTT boxes may be equal to N/2 where N/2 denotes the number of channels of the downmix signal.

14 Claims, 13 Drawing Sheets

(51) Int. Cl.
*H04S 5/00* (2006.01)
*G10L 19/008* (2013.01)
*H04S 3/02* (2006.01)

(52) U.S. Cl.
CPC ..... *H04S 3/02* (2013.01); *H04S 2400/01* (2013.01); *H04S 2400/03* (2013.01); *H04S 2400/07* (2013.01); *H04S 2420/03* (2013.01)

(58) Field of Classification Search
CPC ..... H04S 2400/03; H04S 2400/07; H04S 2420/03; G10L 19/008
USPC ..... 381/17, 22, 23
See application file for complete search history.

(56) References Cited

U.S. PATENT DOCUMENTS

| | | | |
|---|---|---|---|
| 2012/0201388 | A1 | 8/2012 | Seo et al. |
| 2012/0321090 | A1 | 12/2012 | Kim et al. |
| 2013/0173274 | A1 | 7/2013 | Kuntz et al. |
| 2016/0071522 | A1 | 3/2016 | Beack et al. |

FOREIGN PATENT DOCUMENTS

| | | | |
|---|---|---|---|
| KR | 10-2007-0094422 | A | 9/2007 |
| KR | 10-2015-0009474 | A | 1/2015 |

OTHER PUBLICATIONS

Herre, J. et al., "MPEG Surround—The ISO/MPEG Standard for Efficient and Compatible Multichannel Audio Coding," Journal of the Audio Engineering Society, vol. 56.11, 2008 (pp. 932-955).

International Search Report issued in counterpart International Application No. PCT/KR2016/001613 dated Jul. 11, 2016 (3 pages in English; 4 pages in Korean).

MULTICHANNEL SIGNAL PROCESSING METHOD, AND MULTICHANNEL SIGNAL PROCESSING APPARATUS FOR PERFORMING THE METHOD

CROSS-REFERENCE TO RELATED APPLICATION(S)

This present application is a continuation of U.S. patent application Ser. No. 15/551,734 filed Aug. 17, 2017, which is a U.S. national stage application of International Application No. PCT/KR2016/001613 filed on Feb. 17, 2016, which claims the benefit under 35 U.S.C. § 119(a) of Korean Patent Application Nos. 10-2015-0024464 filed on Feb. 17, 2015, and 10-2016-0018462 filed on Feb. 17, 2016, in the Korean Intellectual Property Office, the entire disclosures of which are incorporated herein by reference for all purposes.

TECHNICAL FIELD

One or more example embodiments relate to a multichannel signal processing method and a multichannel signal processing apparatus for performing the method, and more particularly, to a method and apparatus that may compress a multichannel signal with degrading a sound quality regardless of an increase in the number of channels included in the multichannel signal.

RELATED ART

MPEG Surround (MPS) is a codec for coding a multichannel signal, such as a 5.1-channel signal, a 7.1-channel signal, etc. MPS may compress a multichannel signal at a relatively high compression ratio and may transmit the compressed multichannel signal.

MPS has some constraints, such as backward compatibility, during an encoding/decoding process. That is, a bitstream of a multichannel signal generated through MPS requires the backward compatibility that the bitstream is to be reproduced in a mono format or a stereo format through an existing codec.

Accordingly, although a multichannel signal having the number of channels greater than the number of channels defined in MPS is input, a signal that is output and transmitted from MPS is to be represented in the same mono format or stereo format as MPS. A decoder may decode a multichannel signal from a bitstream based on additional information received from an encoder. The decoder may restore the multichannel signal using additional information for up-mixing.

Currently, with enhancement of a communication environment, a transmission bandwidth has increased and a bandwidth to be allocated to a signal has also increased. Thus, technology is developing to maintain a sound quality of an original multichannel signal rather than excessively compressing the multichannel signal to correspond to a bandwidth. However, compression is still required for transmission in order to process the multichannel signal having a large number of channels.

Accordingly, there is a need for a method that may reduce a data amount and perform transmission by compressing a multichannel signal at a threshold level or more while maintaining quality of the multichannel signal in the case of processing an input signal having the number of channels greater than the number of channels defined in an MPS standard.

DESCRIPTION

Subject

An aspect of an example embodiment provides a method and apparatus that may process a multichannel signal through an N-N/2-N configuration.

Solution

A multichannel signal processing method according to an example embodiment includes identifying an N/2-channel downmix signal derived from an N-channel input signal; and generating an N-channel output signal from the identified N/2-channel downmix signal using a plurality of one-to-two (OTT) boxes. If a low frequency effect (LFE) channel is absent in the output signal, the number of OTT boxes is equal to N/2 where N/2 denotes the number of channels of the downmix signal.

Each of the plurality of OTT boxes may generate a 2-channel output signal using a 1-channel downmix signal and a decorrelated signal generated from a corresponding decorrelator.

If N exceeds M where N denotes the number of channels of the output signal and M denotes the preset number of channels, the decorrelator may include a first decorrelator corresponding to a channel of M or less and a second decorrelator corresponding to a channel greater than M, and the second decorrelator may reuse a filter set of the first decorrelator.

An OTT box from which an LFE channel is output, among the plurality of OTT boxes, may generate a 2-channel downmix signal without using the decorrelated signal.

If a transmitted residual signal is present, each of the plurality of OTT boxes may generate a 2-channel output signal using the residual signal and the 1-channel downmix signal instead of using the decorrelated signal.

The generating of the N-channel output signal may include generating the N-channel output signal using a pre-decorrelator matrix M1 and a mix matrix M2.

Each of the plurality of OTT boxes may generate the N-channel output signal using a channel level difference (CLD).

N denoting the number of channels of the output signal may be an even number among numbers from 10 to 32.

A multichannel signal processing method according to another example embodiment includes decoding an N/2-channel downmix signal encoded based on a first coding scheme; and generating an N-channel output signal from the N/2-channel downmix signal based on a second coding scheme. If an LFE channel is absent in the output signal, the number of OTT boxes is equal to N/2 where N/2 denotes the number of channels of the downmix signal.

A multichannel signal processing apparatus according to an example embodiment includes a processor to implement a multichannel signal processing method. The processor is configured to identify an N/2-channel downmix signal derived from an N-channel input signal, and generate an N-channel output signal from the identified N/2-channel downmix signal using a plurality of OTT boxes. If an LFE channel is absent in the output signal, the number of OTT boxes is equal to N/2 where N/2 denotes the number of channels of the downmix signal.

Each of the plurality of OTT boxes may generate a 2-channel output signal using a 1-channel downmix signal and a decorrelated signal generated from a corresponding decorrelator.

If N exceeds M where N denotes the number of channels of the output signal and M denotes the preset number of channels, the decorrelator may include a first decorrelator corresponding to a channel of M or less and a second decorrelator corresponding to a channel greater than M, and the second decorrelator may reuse a filter set of the first decorrelator.

An OTT box from which an LFE channel is output, among the plurality of OTT boxes, may generate a 2-channel downmix signal without using the decorrelated signal.

If a transmitted residual signal is present, each of the plurality of OTT boxes may generate a 2-channel output signal using the residual signal and the 1-channel downmix signal instead of using the decorrelated signal.

The processor may generate the N-channel output signal using a pre-decorrelator matrix) M1 and a mix matrix M2.

Each of the plurality of OTT boxes may generate the N-channel output signal using a CLD.

N denoting the number of channels of the output signal may be an even number among numbers from 10 to 32.

A multichannel signal processing apparatus according to another example embodiment includes a processor to implement a multichannel signal processing method. The processor is configured to decode an N/2-channel downmix signal encoded based on a first coding scheme, and generate an N-channel output signal from the N/2-channel downmix signal based on a second coding scheme. If an LFE channel is absent in the output signal, the second coding scheme uses the number of OTT boxes equal to N/2 where N/2 denotes the number of channels of the downmix signal.

Effect

According to example embodiments, it is possible to efficiently process a multichannel signal having the number of channels greater than the number of channels defined in MPEG Surround (MPS) by processing the multichannel signal based on an N-N/2-N configuration.

MODE

Hereinafter, example embodiments will be described with reference to the accompanying drawings. A process of generating an N/2-channel downmix signal from an N-channel input signal through an MPEG Surround (MPS) encoder and generating an N-channel output signal using the N/2-channel downmix signal through an MPS decoder according to example embodiments will be described. Here, N/2 denotes the number of channels greater than the number of channels defined in the existing MPS standard. For example, the MPS decoder according to example embodiments may satisfy an expanded MPS standard for an MPEG-H 3D audio standard.

Hereinafter, example embodiments will be described with reference to the accompanying drawings.

Herein, an encoding apparatus and a decoding apparatus correspond to a multichannel signal processing apparatus.

Figure 1:
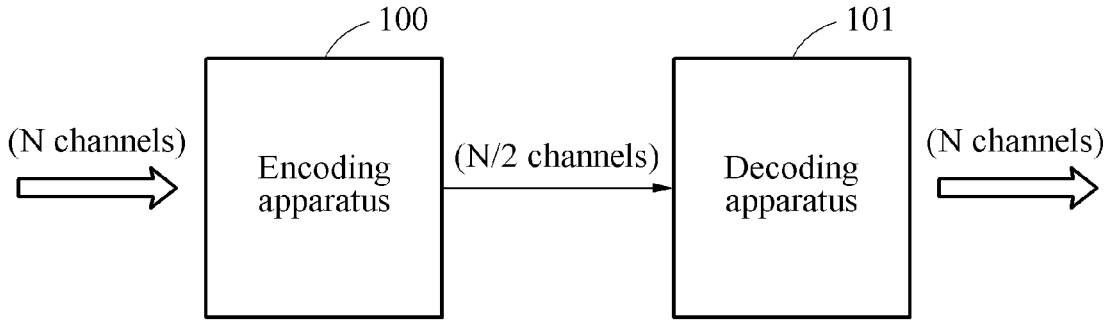
FIG. 1 is a diagram illustrating an encoding apparatus and a decoding apparatus according to an example embodiment.

FIG. 1 is a diagram illustrating an encoding apparatus and a decoding apparatus according to an example embodiment.

An encoding apparatus 100 according to an example embodiment may generate an N/2-channel downmix signal by downmixing an N-channel input signal. A decoding apparatus 101 may generate an N-channel output signal using the N/2-channel downmix signal. Here, N may be 10 or more.

Figure 2:
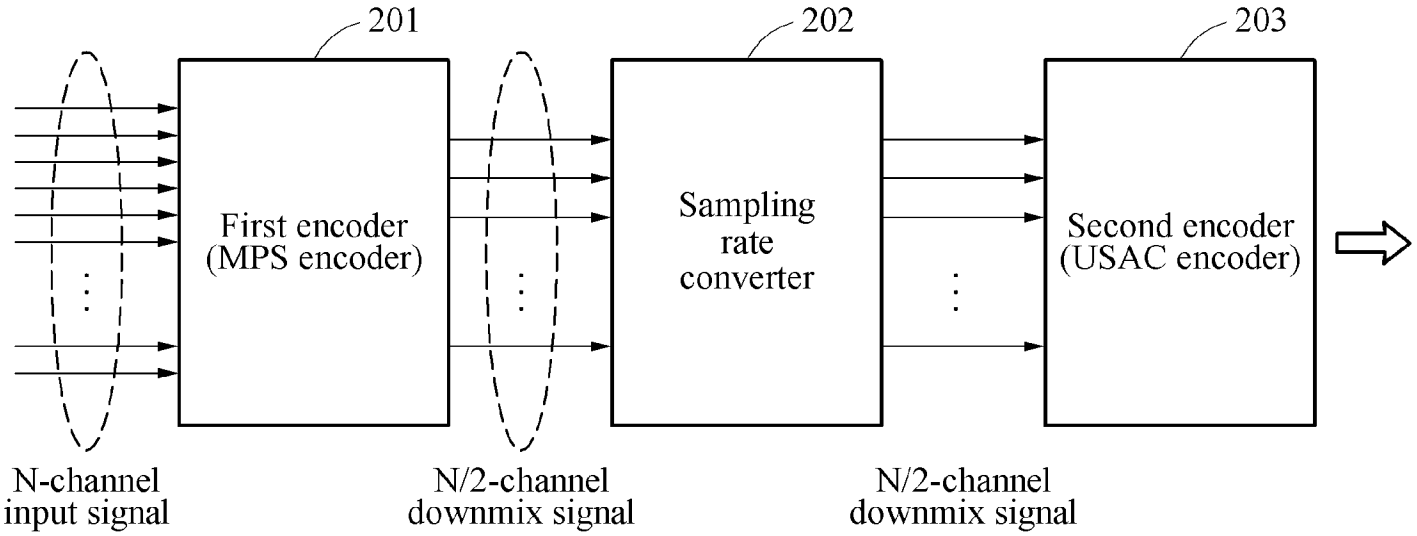
FIG. 2 is a diagram illustrating constituent elements of an encoding apparatus according to an example embodiment.

FIG. 2 is a diagram illustrating constituent elements of an encoding apparatus according to an example embodiment.

Referring to FIG. 2, the encoding apparatus may include a first encoder 201, a sampling rate converter 202, and a second encoder 203. The first encoder 201 is defined as an MPS encoder. The second encoder 203 is defined as a Unified Speech and Audio Codec (USAC) encoder. That is, the first encoder 201 may generate an N/2-channel downmix signal by downmixing an N-channel input signal.

The sampling rate converter 202 may convert a sampling rate of the N/2-channel downmix signal. The sampling rate converter 202 may perform down-sampling at a bitrate allocated to the USAC encoder, i.e., the second encoder 203. If a sufficiently high bitrate is allocated to the USAC encoder, i.e., the second encoder 203, the sampling rate converter 202 may be bypassed.

The second encoder 203 may perform encoding with respect to a core band of the N/2-channel downmix signal of which the sampling rate is converted. In this manner, the N/2-channel downmix signal encoded through the second encoder 203 may be generated. The encoded N/2-channel downmix signal may be a signal of M channels where M is less than or equal to N/2. Here, when a frequency band is expanded through Spectral Band Replication (SBR) applied at the USAC encoder, the core band indicates a low frequency band of which a frequency band is not expanded.

According to the existing MPS standard, the number of channels of a downmix signal (also referred as the number of downmix signal channels) output through the MPS encoder corresponding to the first encoder 201 is limited to 1 channel, 2 channels, and 5.1 channels. However, the first encoder 201 according to an example embodiment may exceed the number of channels of downmix signal channels defined in the MPS standard. That is, the first encoder 201 may generate the N/2-channel downmix signal by downmixing the N-channel input signal. In the N/2-channel downmix signal, N/2 channels may be 1, 2, 5.1, or 5.1 or more.

Figure 3:
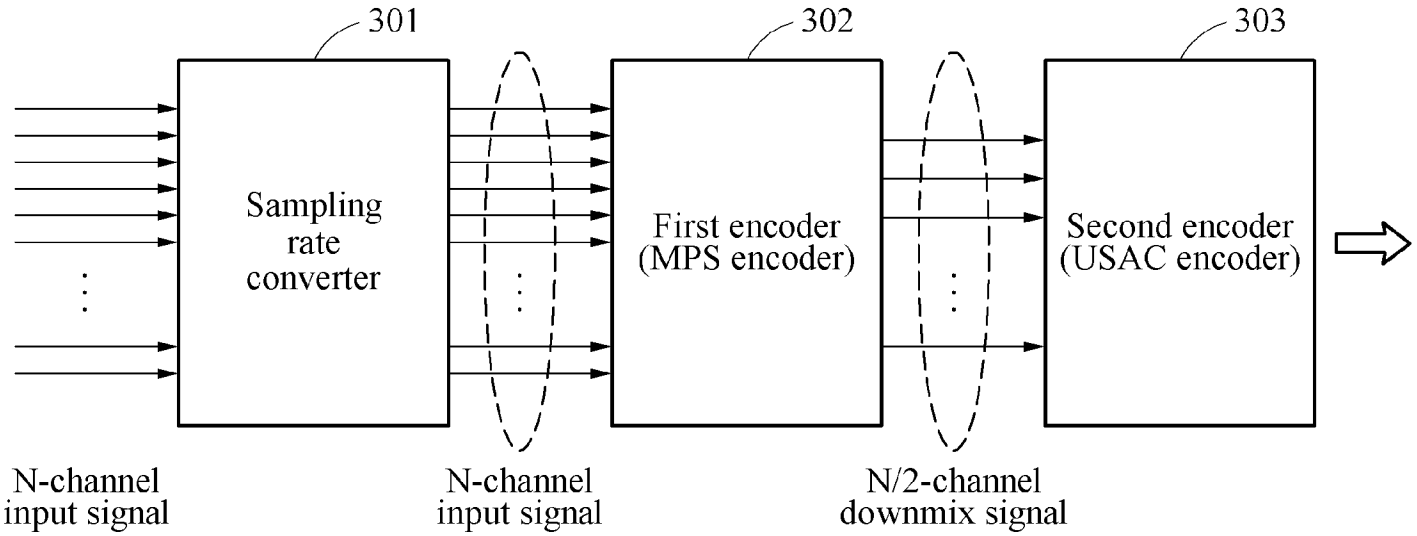
FIG. 3 is a diagram illustrating constituent elements of an encoding apparatus according to another example embodiment.

FIG. 3 is a diagram illustrating constituent elements of an encoding apparatus according to another example embodiment.

FIG. 3 illustrates an example in which like constituent elements as those of FIG. 2 are included and orders thereof are modified. In detail, FIG. 2 illustrates an example in which the sampling rate converter 202 is present between the first encoder 201 and the second encoder 203, whereas FIG. 3 illustrates an example in which the first encoder 302 and the second encoder 303 are provided after the sampling rate converter 301.

Figure 4:
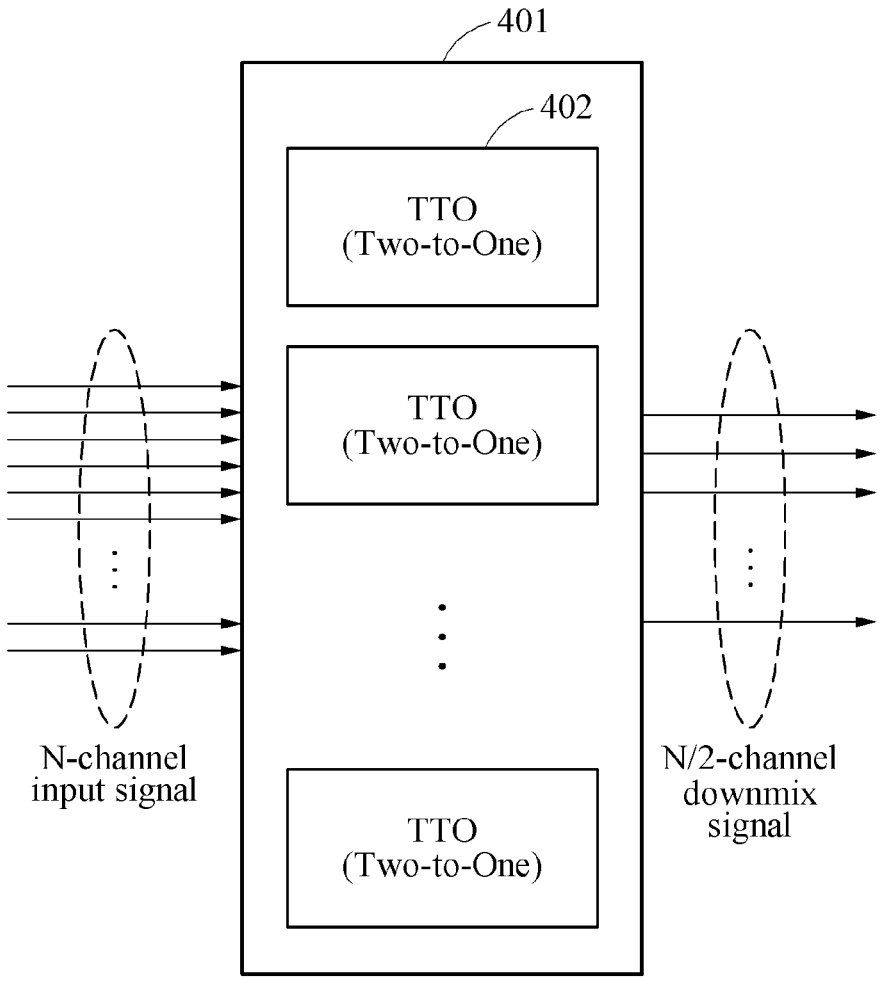
FIG. 4 is a diagram illustrating an operation of a first encoder according to an example embodiment.

FIG. 4 is a diagram illustrating an operation of a first encoder according to an example embodiment.

FIG. 4 illustrates a process of generating an N/2-channel downmix signal from an N-channel input signal. Referring to FIG. 4, a first encoder 401 may include a plurality of two-to-one (TTO) boxes 402. Each of the plurality of TTO boxes 402 may generate a 1-channel downmix signal by downmixing a 2-channel input signal. That is, to generate the N/2-channel downmix signal by downmixing the input N-channel input signal, the first encoder 401 may include N/2 TTO boxes 402.

If the first encoder 401 follows the existing MPS standard, only 1 channel, 2 channels, or 5.1 channels may be allowed for a downmix signal generated at the first encoder 401. According to an example embodiment, the first encoder 401 may generate an N/2-channel downmix signal from an N-channel input signal based on MPS. Here, N/2 channels may be 1 channel, 2 channels, or 5.1 channels, or 5.1 or more channels. If the number of N channels is greater than the number of channels defined in MPS, the first encoder 401 may need to consider additional syntax to control MPS. For example, the first encoder 401 may define additional syntax to control MPS based on a coding mode using an arbitrary tree.

Figure 5:
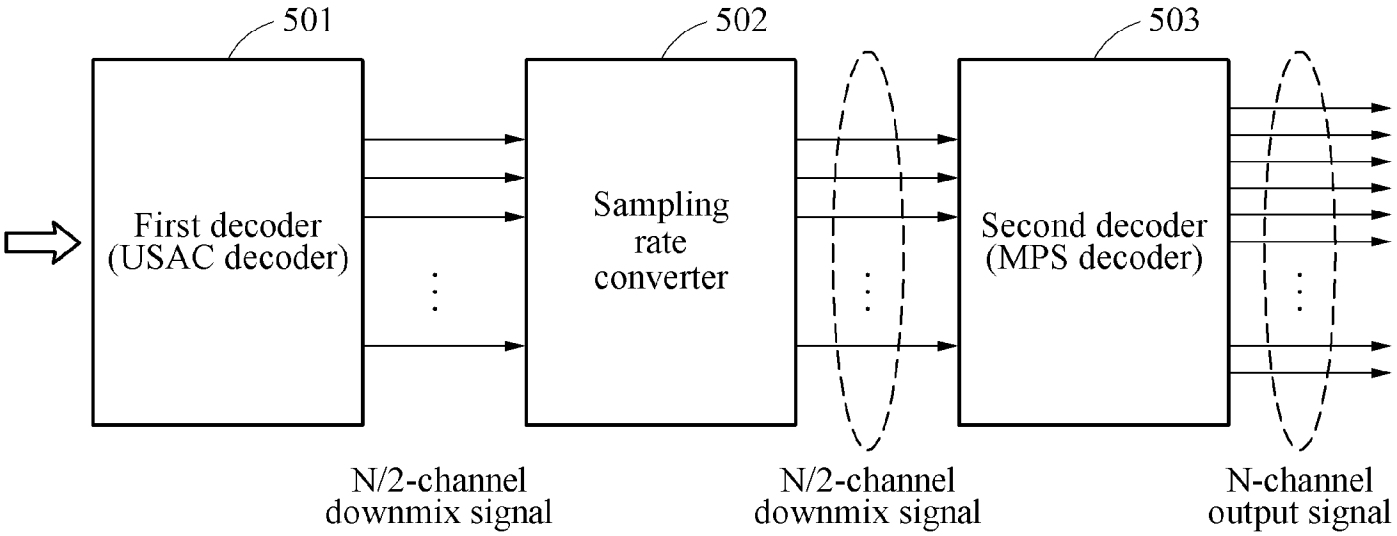
FIG. 5 is a diagram illustrating constituent elements of a decoding apparatus according to an example embodiment.

FIG. 5 is a diagram illustrating constituent elements of a decoding apparatus according to an example embodiment.

FIG. 5 illustrates a process of generating an N-channel output signal from an N/2-channel downmix signal. Referring to FIG. 5, the decoding apparatus may include a first decoder 501, a sampling rate converter 502, and a second decoder 503. The first decoder 501 may restore an N/2-channel downmix signal by decoding an encoded N/2-channel downmix signal. Here, the first decoder 501 may be defined as a USAC decoder.

The sampling rate converter 502 may convert a sampling rate of the N/2-channel downmix signal. Here, the sampling rate converter 502 may convert a sampling rate of an audio signal converted at an encoding apparatus to an original sampling rate. That is, if a sampling rate conversion is performed in FIG. 2 or FIG. 3, the sampling rate converter 502 operates. Conversely, unless a sampling rate conversion is performed in FIG. 2 or FIG. 3, the sampling rate converter 502 may be bypassed without being operated.

The second decoder 503 may generate an N-channel output signal by upmixing the N/2-channel downmix signal output from the sampling rate converter 502.

The number of channels for a downmix signal input to a conventional MPS decoder is limited to 1 channel, 2 channels, and 5.1 channels. However, the number of channels for a downmix signal input to the second decoder 503 according to an example embodiment may be expanded up to N/2 channels in addition to 1 channel, 2 channels, and 5.1 channels. The second decoder 503 may generate the N-channel output signal by upmixing the N/2-channel downmix signal. Here, the N/2-channel downmix signal input to the second decoder 503 indicates 5.1 channels or more and thus, N may be 10.2 channels or more.

Figure 6:
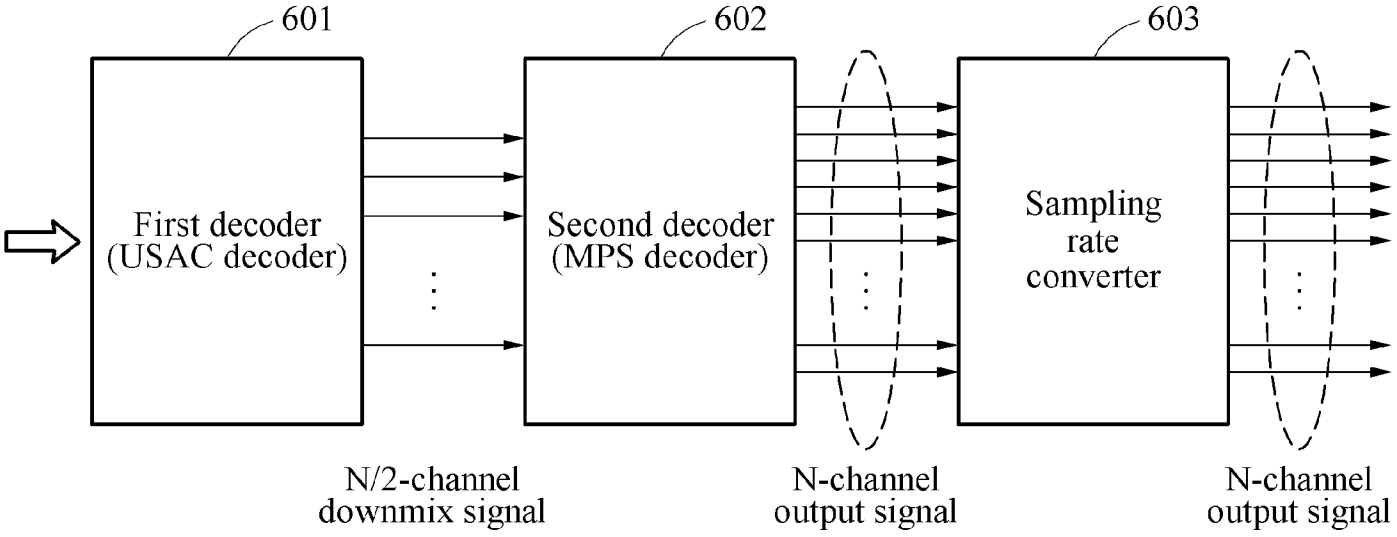
FIG. 6 is a diagram illustrating constituent elements of a decoding apparatus according to another example embodiment.

FIG. 6 is a diagram illustrating constituent elements of a decoding apparatus according to another example embodiment.

In FIG. 6, the decoding apparatus may process an audio signal in order of a first decoder 601, a second decoder 602, and a sampling rate converter 603, which differs from FIG. 5. The first decoder 601 may restore an N/2-channel downmix signal. The second decoder 602 may generate an N-channel output signal by upmixing the N/2-channel downmix signal. The sampling rate converter 603 may convert a sampling rate of the N-channel output signal generated through the second decoder 602.

Figure 7:
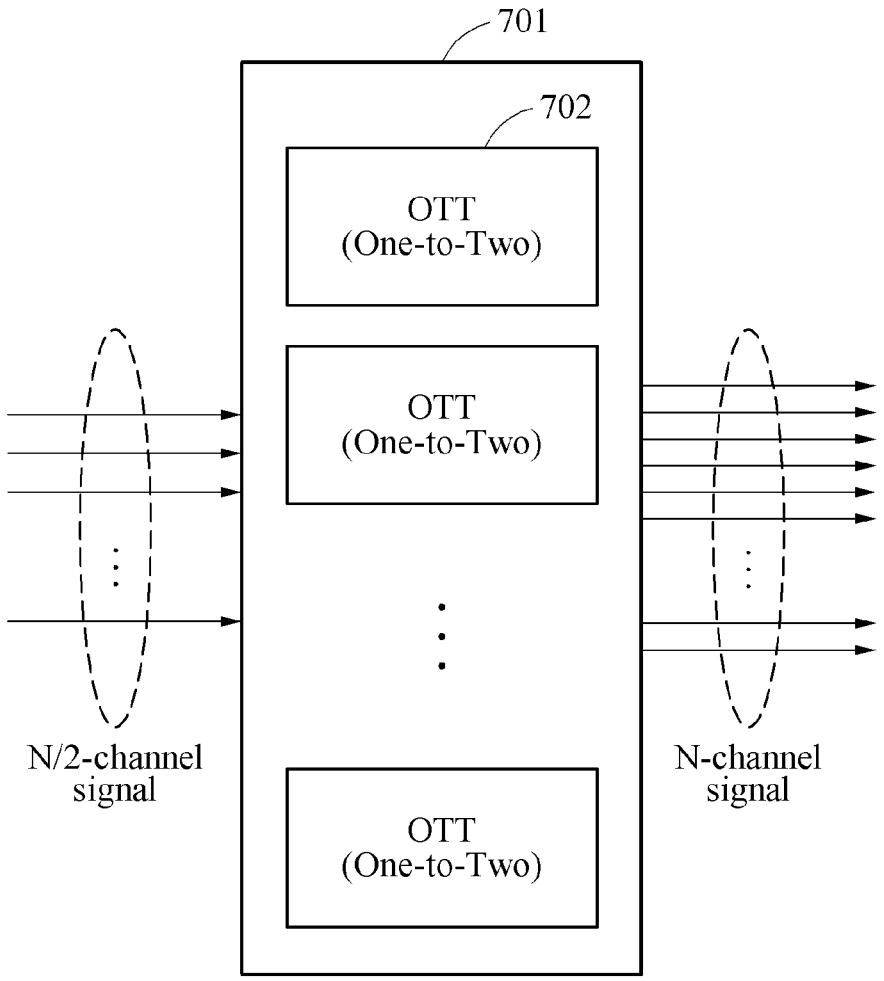
FIG. 7 is a diagram illustrating an operation of a second decoder according to an example embodiment.

FIG. 7 is a diagram illustrating an operation of a second decoder according to an example embodiment.

As described above with reference to FIGS. 5 and 6, a second decoder 701 may generate an N-channel output signal by upmixing an N/2-channel downmix signal. The second decoder 701 may include a plurality of one-to-two (OTT) boxes 702. The OTT box 702 may generate a stereo type of a 2-channel output signal by upmixing a 1-channel downmix signal.

Accordingly, to generate the N-channel output signal by upmixing the N/2-channel downmix signal, the second decoder 701 may include N/2 OTT boxes 702.

If the second decoder 701 follows the existing MPS standard, the number of channels of a downmix signal to be input to and processed at the second decoder 701 may be 1 channel, 2 channels, or 5.1 channels. According to an example embodiment, the second decoder 701 may generate the N-channel output signal from the N/2-channel downmix signal based on MPS. Here, N may be 10.2 or more.

Here, the second decoder 701 may need to consider additional syntax to control MPS. For example, the second decoder 701 may define additional syntax to control MPS based on a coding mode using an arbitrary tree.

An MPS decoder described in FIGS. 8 through 12 relates to the second decoder 503 of FIG. 5 and the second decoder 602 of FIG. 6.

Figure 8:
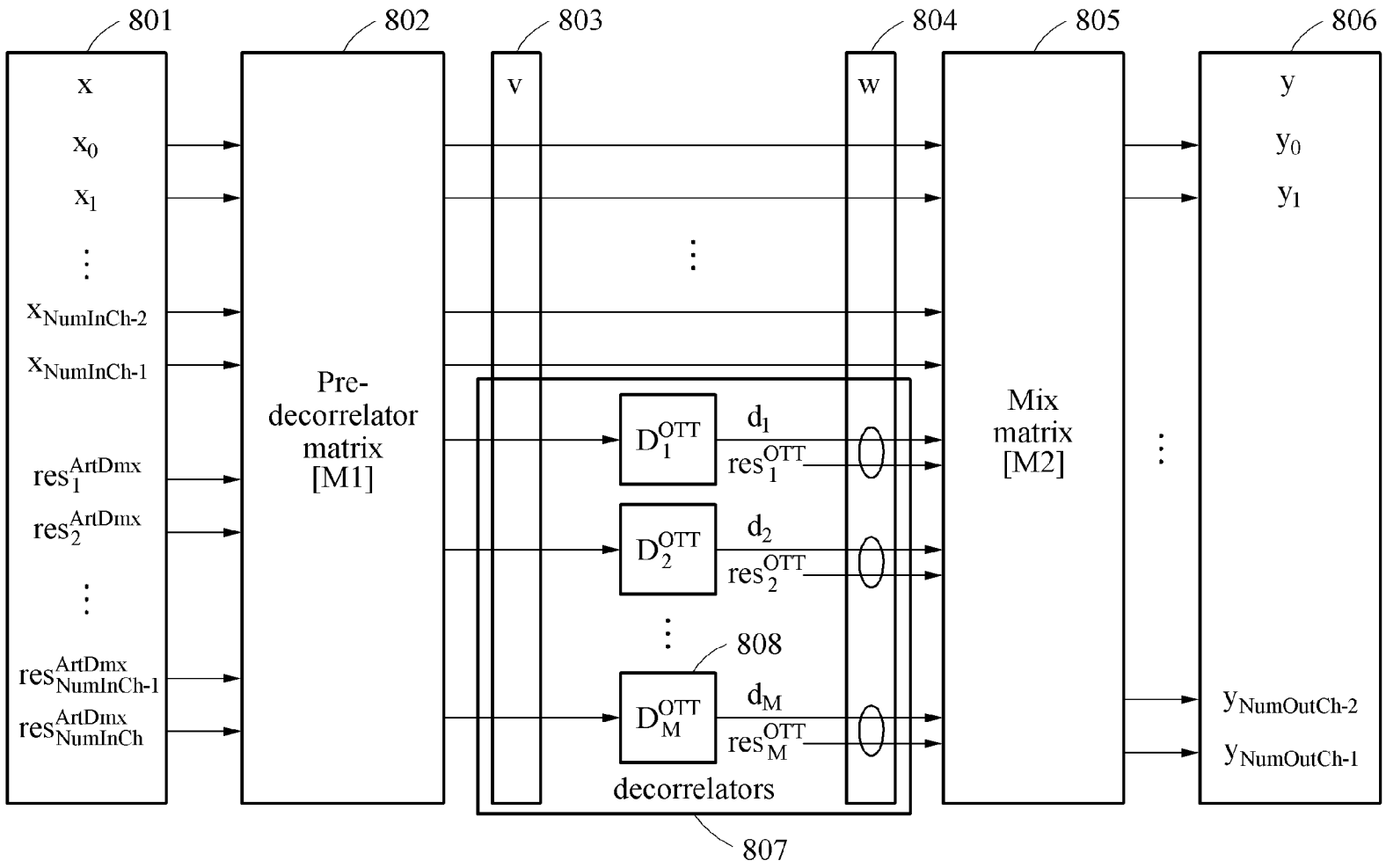
FIG. 8 is a diagram illustrating a spatial audio processing process for an N-N/2-N configuration according to an example embodiment.

FIG. 8 illustrates a process of processing a multichannel signal based on an N-N/2-N configuration.

Figure 13:
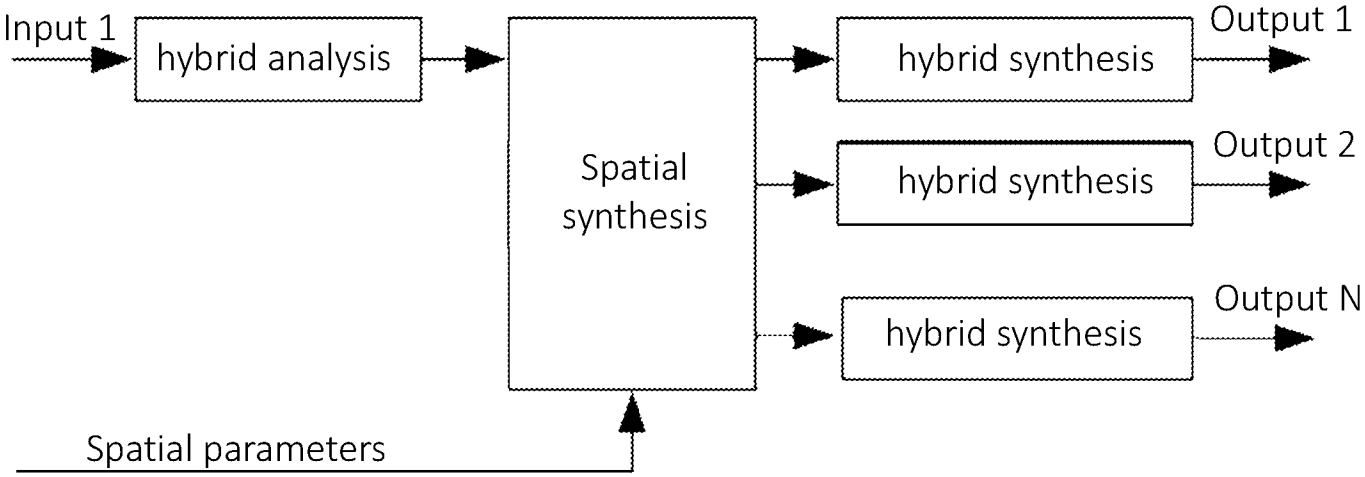
FIG. 13 is a diagram illustrating a decoder for performing spatial synthesis.

FIG. 8 illustrates an N-N/2-N configuration modified from a configuration defined in MPS. In the case of MPS, spatial synthesis may be performed at a decoder as shown in FIG. 13. The spatial synthesis may convert input signals from a time domain to a non-uniform subband domain using a hybrid quadrature mirror filter (QMF) analysis bank. Here, the term "non-uniform" corresponds to hybrid.

The decoder operates in a hybrid subband. The decoder may generate output signals from input signals by performing spatial synthesis based on spatial parameters transferred from the encoder. The decoder may inversely convert output signals from the hybrid subband to the time domain using the hybrid QMF synthesis bank.

A process of processing a multichannel signal through a matrix mixed with spatial synthesis performed at the decoder is described with reference to FIG. 8. Basically, a 5-1-5 configuration, a 5-2-5 configuration, a 7-2-7 configuration, and a 7-5-7 configuration are defined in MPS, while an N-N/2-N configuration is proposed herein.

The N-N/2-N configuration provides a process of converting an N-channel input signal to an N/2-channel downmix signal and generating an N-channel output signal from the N/2-channel downmix signal. A decoder according to an example embodiment may generate the N-channel output signal by upmixing the N/2-channel downmix signal. Basically, the number of N channels is not limited in the N-N/2-N configuration. That is, the N-N/2-N configuration may support a channel configuration of a multichannel signal not supported in MPS, as well as a channel configuration supported in MPS.

In FIG. 8, N/2 denotes the number of downmix signal channels derived through MPS. NumInCh denotes the number of downmix signal channels, and NumOutCh denotes the number of channels of an output signal (also referred to as the number of output signal channels). In detail, the number of downmix signal channels, NumInCh, is N/2. That is, NumInCh=N/2 and NumOutCh=N.

In FIG. 8, N/2-channel downmix signals ($X_0$ to $X_{NumInch-1}$) and residual signals (res) constitute an input vector X. Since NumInCh=N/2, $X_0$ to $X_{NumInCh-1}$ denote N/2-channel downmix signals. Since the number of OTT boxes is N/2, N should be an even number to process the N/2-channel downmix signals. Here, N denotes the number of output signal channels. For example, N may be an even number among numbers from 10 to 32.

In FIG. 8, decorrelators labeled from 1 to M (NumInCh to NumLfe), decorrelated signals, and residual signals correspond to different OTT boxes, respectively. A restoration process for a multichannel signal to which the N-N/2-N configuration is applied may be visualized in a tree structure.

The input vector X to be multiplied by a vector $M_1^{n,k}$ corresponding to a matrix M1 denotes a vector that includes the N/2-channel downmix signals. When a low frequency effect (LFE) channel is absent in an N-channel output signal, a maximum of N/2 decorrelators may be used to generate a decorrelated signal. However, if the number of output signal channels, N, exceeds 20, filters of a decorrelator may be reused.

To guarantee orthogonality between output signals of decorrelators, if N=20, there is a need to limit the number of available decorrelators to a specific number, for example, 10. Thus, indices of some decorrelators may be repeated. According to an example embodiment, in the N-N/2-N configuration, N that is the number of output signal channels is to be less than two times of the specific number. For example, N<20. If an LFE channel is included in an output signal, the number of output signal channels may need to be configured using the number of channels less than two times of the specific number based on the number of LFE channels. For example, N<24.

Output results of decorrelators may be replaced with residual signals for a specific frequency domain based on a bitstream. If an LFE channel is one of outputs of OTT boxes, a decorrelator is not used for an upmix-based OTT box.

In FIG. 8, the decorrelators labeled from 1 to M (e.g., NumInCh to NumLfe), output results, for example, decorrelated signals, of the decorrelators, and residual signals correspond to different OTT boxes, respectively. Here, $d_1$ to $d_M$ denote decorrelated signals that are output results of the decorrelators $D_1$ to $D_M$, and $res_1$ to $res_M$ denote residual signals that are output results of the decorrelators Di to $D_M$. The decorrelators $D_1$ to $D_M$ correspond to different OTT boxes, respectively.

Hereinafter, a vector and a matrix used in the N-N/2-N configuration are defined. In the N-2/N-N configuration, an input signal input to a decorrelator is defined as a vector $v^{n,k}$.

The vector $v^{n,k}$ may be determined to be different depending on whether a temporal shaping tool is used or not used.

(1) In an example in which the temporal shaping tool is not used:

If the temporal shaping tool is not used, the vector $v^{n,k}$ is derived based on the vector $X^{n,l}$ and $M_1^{n,k}$ corresponding to the matrix M1 according to Equation 1. Here, $M_1^{n,k}$ denotes a matrix including an N-th row and a first column.

[Equation 1]

$$v^{n,k} = M_1^{n,k} x^{n,k} = M_1^{n,k} \begin{bmatrix} x_{M_0}^{n,k} \\ x_{M_1}^{n,k} \\ \cdots \\ x_{M_{NumInCh-1}}^{n,k} \\ x_{res_0^{ArtDmx}}^{n,k} \\ x_{res_1^{ArtDmx}}^{n,k} \\ \cdots \\ x_{res_{NumInCh-1}^{ArtDmx}}^{n,k} \end{bmatrix} = \begin{bmatrix} v_{M_0}^{n,k} \\ v_{M_1}^{n,k} \\ \cdots \\ v_{M_{NumInCh-1}}^{n,k} \\ v_0^{n,k} \\ v_1^{n,k} \\ \cdots \\ v_{NumInCh-NumLfe-1}^{n,k} \end{bmatrix}$$

In Equation 1, among elements of the vector $V^{n,k}$, $V_{M_0}^{n,k}$ to $V_{M_{NumInCh-NumLfe-1}}^{n,k}$ may be directly input to a matrix M2 instead of being input to N/2 decorrelators corresponding to N/2 OTT boxes. Accordingly, each of $V_{M_0}^{n,k}$ to $V_{M_{NumInCh-NumLfe-1}}^{n,k}$ may be defined as a direct signal. Remaining signals ($V_0^{n,k}$ to $V_{NumInCh-NumLfe-1}^{n,k}$) excluding the elements $V_{M_0}^{n,k}$ to $V_{M_{NumInCh-NumLfe-1}}^{n,k}$ from the elements of the vector $V^{n,k}$ may be input to the N/2 decorrelators corresponding to the N/2 OTT boxes.

A vector $W^{n,k}$ includes direct signals, $d_1$ to $d_M$ that are decorrelated signals output from decorrelators, and $res_1$ to $res_M$ that are residual signals output from the decorrelators. The vector $w^{n,k}$ may be determined according to Equation 2.

[Equation 2]

$$w^{n,k} = \begin{bmatrix} v_{M_0}^{n,k} \\ v_{M_1}^{n,k} \\ \cdots \\ v_{M_{NumInCh-1}}^{n,k} \\ \delta_0(k) D_0\left(v_{M_0}^{n,k}\right) + (1-\delta_0(k)) v_{res_0}^{n,k} \\ \delta_1(k) D_1\left(v_{M_2}^{n,k}\right) + (1-\delta_1(k)) v_{res_1}^{n,k} \\ \cdots \\ \delta_{NumInCh-NumLfe-1}(k) D_{NumInCh-NumLfe-1}\left(v_{M_{NumInCh-NumLfe-1}}^{n,k}\right) + \\ (1-\delta_{NumInCh-NumLfe-1}(k)) v_{res_{NumInCh-NumLfe-1}}^{n,k} \end{bmatrix} = \begin{bmatrix} w_{M_0}^{n,k} \\ w_{M_1}^{n,k} \\ \cdots \\ w_{M_{NumInCh-1}}^{n,k} \\ w_1^{n,k} \\ w_2^{n,k} \\ \cdots \\ w_{NumInCh-NumLfe-1}^{n,k} \end{bmatrix}$$

In Equation 2, $$\delta_x(k) = \begin{cases} 0, & 0 \le k \le \max\{k_{set}\} \\ 1, & \text{otherwise} \end{cases},$$

and $k_{set}$ denotes a set of all k satisfying $K(k)<m_{resProc}(X)$. $D_x(v_x^{n,k})$ denotes a decorrelated signal output from a decorrelator in response to a signal $v_x^{n,k}$ being input to a decorrelator $D_x$. In particular, $D_X(v_x^{n,k})$ denotes a signal that is output from a decorrelator if an OTT box is OTTx and a residual signal is $V_{res_x}^{n,k}$.

A subband of an output signal may be defined to be dependent on all of time slots n and all of hybrid subbands k. An output signal $y^{n,k}$ may be determined based on the vector w and the matrix M2 according to Equation 3.

[Equation 3]

$$y^{n,k} = M_2^{n,k} w^{n,k} = M_2^{n,k} \begin{bmatrix} w_{M_0}^{n,k} \\ w_{M_1}^{n,k} \\ \cdots \\ w_{M_{NumInCh-1}}^{n,k} \\ w_1^{n,k} \\ w_2^{n,k} \\ \cdots \\ w_{NumInCh-NumLfe-1}^{n,k} \end{bmatrix} = \begin{bmatrix} y_0^{n,k} \\ y_1^{n,k} \\ \cdots \\ y_{NumInCh-2}^{n,k} \\ y_{NumInCh-1}^{n,k} \end{bmatrix}$$

In Equation 3, $M_2^{n,k}$ denotes the matrix M2 including a row NumOutCh and a column NumInCh-NumLfe. Here, $M_2^{n,k}$ may be defined with respect to $0 \le l < L$ and $0 \le k < K$, as expressed by Equation 4.

[Equation 4]

$$M_2^{n,k} = \begin{cases} W_2^{l,k}\alpha(n,l) + (1-\alpha(n,l))W_2^{-1,k}, & , 0 \le n \le t(l),\ l = 0 \\ W_2^{l,k}\alpha(n,l) + (1-\alpha(n,l))W_2^{l-1,k}, & , t(l-1) < n \le t(l),\ 1 \le l < L \end{cases}$$

In Equation 4, $$\alpha(n,l) = \begin{cases} \dfrac{n+1}{t(l)+1}, & l = 0 \\ \dfrac{n-t(l-1)}{t(l)-t(l-1)}, & \text{otherwise} \end{cases},$$

and $W_2^{l,k}$ may be smoothed as expressed by Equation 5.

[Equation 5]

$$W_2^{l,k} = \begin{cases} s_{delta}(l)\cdot R_2^{l,\kappa(k)} + (1-s_{delta}(l))\cdot W_2^{l-1,k}, & S_{proc}(l,\kappa(k)) = 1 \\ R_2^{l,\kappa(k)}, & S_{proc}(l,\kappa(k)) = 0 \end{cases}$$

In Equation 5, κ(k) denotes a function of which a first row is a hybrid band k and of which a second row is a processing band, and $W_2^{-1,k}$ corresponds to a last parameter set of a previous frame.

Meanwhile, $y^{n,k}$ may denote hybrid subband signals synthesizable to the time domain through a hybrid synthesis filter bank. Here, the hybrid synthesis filter bank is combined with a QMF synthesis bank through Nyquist synthesis banks, and $y^{n,k}$ may be converted from the hybrid subband domain to the time domain through the hybrid synthesis filter bank.

(2) In an example in which the temporal shaping tool is used:

If the temporal shaping tool is used, the vector $V^{n,k}$ may be the same as described above, however, the vector $W^{n,k}$ may be classified into two types of vectors as expressed by Equation 6 and Equation 7.

[Equation 6]

$$w_{direct}^{n,k} = \begin{bmatrix} v_{M_0}^{n,k} \\ v_{M_1}^{n,k} \\ \cdots \\ v_{M_{NumInCh-1}}^{n,k} \\ (1-\delta_0(k))v_{res_0}^{n,k} \\ (1-\delta_0(k))v_{res_1}^{n,k} \\ \cdots \\ (1-\delta_2(k))v_{res_{NumInCh-NumLfe-1}}^{n,k} \end{bmatrix} = \begin{bmatrix} w_{M_0}^{n,k} \\ w_{M_1}^{n,k} \\ \cdots \\ w_{M_{NumInCh-1}}^{n,k} \\ w_0^{n,k} \\ w_1^{n,k} \\ \\ w_{NumInCh-NumLfe-1}^{n,k} \end{bmatrix}$$

[Equation 7]

$$w_{diffuse}^{n,k} = \begin{bmatrix} v_{M_0}^{n,k} \\ v_{M_1}^{n,k} \\ \cdots \\ v_{M_{NumInCh-1}}^{n,k} \\ \delta_0(k)D_0(v_0^{n,k}) \\ \delta_1(k)D_1(v_1^{n,k}) \\ \cdots \\ \delta_{NumInCh-NumLfe-1}(k)D_{NumInCh-NumLfe-1}(v_{NumInCh-NumLfe-1}^{n,k}) \end{bmatrix} = \begin{bmatrix} w_{M_0}^{n,k} \\ w_{M_1}^{n,k} \\ \cdots \\ w_{M_{NumInCh-1}}^{n,k} \\ w_0^{n,k} \\ w_1^{n,k} \\ \cdots \\ w_{NumInCh-NumLfe-1}^{n,k} \end{bmatrix}$$

Here, $W_{direct}^{n,k}$ denotes a direct signal that is directly input to the matrix M2 without passing through decorrelators and residual signals output from the decorrelators, and $W_{diffuse}^{n,k}$ denotes a decorrelated signal output from a decorrelator. Further, $$\delta_X(k) = \begin{cases} 0, & 0 \le k \le \max\{k_{set}\} \\ 1, & \text{otherwise} \end{cases},$$

and $k_{set}$ denotes a set of all k satisfying $K(k)<m_{resProc}(X)$. Also, $D_x(V_x^{n,k})$ denotes a decorrelated signal output from the decorrelator $D_x$ in response to the input signal $v_x^{n,k}$ being input to the decorrelator $D_x$.

Signals finally output by $w_{direct}^{n,k}$ and $w_{diffuse}^{n,k}$ defined in Equation 6 and Equation 7 may be classified into $y_{direct}^{n,k}$ and $y_{diffuse}^{n,k}$. $y_{direct}^{n,k}$ includes a direct signal and $y_{diffuse}^{n,k}$ includes a diffuse signal. That is, $y_{direct}^{n,k}$ is a result that is derived from the direct signal directly input to the matrix M2 without passing through a decorrelator and $y_{diffuse}^{n,k}$ is a result that is derived from the diffuse signal output from the decorrelator and input to the matrix M2.

In addition, $y_{direct}^{n,k}$ and $y_{diffuse}^{n,k}$ may be derived based on a case in which a Subband Domain Temporal Processing (STP) is applied to the N-N/2-N configuration and a case in which Guided Envelope Shaping (GES) is applied to the N-N/2-N configuration. In this instance, $y_{direct}^{n,k}$ and $y_{diffuse}^{n,k}$ are identified using bsTempShapeConfig that is a data stream element.

<Case in Which STP is Applied>

To synthesize decorrelation levels between output signal channels, a diffuse signal is generated through a decorrelator for spatial synthesis. Here, the generated diffuse signal may be mixed with a direct signal. In general, a temporal envelope of the diffuse signal does not match an envelope of the direct signal.

In this instance, STP is applied to shape an envelope of a diffuse signal portion of each output signal to be matched to a temporal shape of a downmix signal transmitted from an encoder. Such processing may be performed by calculating an envelope ratio between the direct signal and the diffuse signal or by estimating an envelope such as shaping of an upper spectrum portion of the diffuse signal.

That is, temporal energy envelopes with respect to a portion corresponding to the direct signal and a portion corresponding to the diffuse signal may be estimated from the output signal generated through upmixing. A shaping factor may be calculated based on a ratio between the temporal energy envelopes with respect to the portion corresponding to the direct signal and the portion corresponding to the diffuse signal.

STP may be signaled to bsTempShapeConfig=1. If bsTempShapeEnableChannel(ch)=1, the diffuse signal portion of the output signal generated through upmixing may be processed through the STP.

Meanwhile, to reduce the necessity of a delay alignment of an original downmix signal transmitted with respect to spatial upmixing for generating an output signal, downmixing of spatial upmixing may be calculated as an approximation of the transmitted original downmix signal.

With respect to the N-N/2-N configuration, a direct downmix signal for NumgInCh-NumLfe may be defined by Equation 8.

$$\hat{z}_{direct,d}^{n,sb} = \sum_{ch \in ch_d} \tilde{z}_{direct,ch}^{n,sb}, \quad 0 \le d < (NumInCh - NumLfe) \qquad \text{[Equation 8]}$$

In Equation 8, $ch_d$ includes a pair-wise output signal corresponding to a channel d of an output signal with respect to the N-N/2-N configuration, and $ch_d$ may be defined with respect to the N-N/2-N configuration, as expressed by Table 1.

TABLE 1

| Configuration | $ch_d$ |
|---|---|
| N-N/2-N | $\{ch_0, ch_1\}_{d=0}, \{ch_2, ch_3\}_{d=1}, \ldots, \{ch_{2d}, ch_{2d+1},\}_{d=NumInCh-NumLfe}$ |

Downmix broadband envelopes and an envelope with respect to a diffuse signal portion of each upmix channel may be estimated based on the normalized direct energy according to Equation 9.

$$E_{direct}^{n,sb} = |\hat{Z}_{direct}^{n,sb} \cdot BP^{sb} \cdot GF^{sb}|^2 \qquad \text{[Equation 9]}$$

In Equation 9, $BP^{sb}$ denotes a band pass factor and $GF^{sb}$ denotes a spectral flattering factor.

In the N-N/2-N configuration, since the direct signal for NumInCh-NumLfe is present, energy $E_{direct_norm,d}$ of the direct signal that satisfies 0≤d<(NumInCh−NumLfe) may be obtained using the same method as that used in a 5-1-5 configuration defined in MPS. A scale factor associated with final envelope processing may be defined by Equation 10.

$$scale_{ch}^{n} = \sqrt{\frac{E_{direct_norm,d}^{n}}{E_{diffuse_norm,ch}^{n} + \varepsilon}}, \quad ch \in \{ch_{2d}, ch_{2d+1}\}_d \qquad \text{[Equation 10]}$$

In Equation 10, the scale factor may be defined if 0≤d<(NumInCh-31 NumLfe) is satisfied with respect to the N-N/2-N configuration. By applying the scale factor to the diffuse signal portion of the output signal, the temporal envelope of the output signal may be substantially mapped to the temporal envelope of the downmix signal. Accordingly, the diffuse signal portion processed using the scale factor in each of channels of the N-channel output signal may be mixed with the direct signal portion. Through this process, whether the diffuse signal portion is processed using the scale factor may be signaled for each of output signal channels. If bsTempShapeEnableChannel(ch)=1, it indicates that the diffuse signal portion is processed using the scale factor.

<Case in Which GES is Applied>

In the case of performing temporal shaping on the diffuse signal portion of the output signal, a characteristic distortion is likely to occur. Accordingly, GES may enhance temporal/spatial quality by outperforming the distortion issue. The decoder may individually process the direct signal portion and the diffuse signal portion of the output signal. In this instance, if GES is applied, only the direct signal portion of the upmixed output signal may be altered.

GES may restore a broadband envelope of a synthesized output signal. GES includes a modified upmixing process after flattening and reshaping an envelope with respect to a direct signal portion for each of output signal channels.

Additional information of a parametric broadband envelope included in a bitstream may be used for reshaping. The additional information includes an envelope ratio between an envelope of an original input signal and an envelope of a downmix signal. The decoder may apply the envelope ratio to a direct signal portion of each of time slots included in a frame for each of output signal channels. Due to GES, a diffuse signal portion for each output signal channel is not altered.

If bsTempShapeConfig=2 a GES process may be performed. If GES is available, each of a diffuse signal and a direct signal of an output signal may be synthesized using a post mixing matrix M2 modified in a hybrid subband domain according to Equation 11.

$$y_{direct}^{n,k}=M_2^{n,k}\,w_{direct}^{n,k}\,y_{diffuse}^{n,k}=M_2^{n,k} \text{ for } 0\le k<K \text{ and } 0\le n<\text{numSlots} \quad \text{[Equation 11]}$$

In Equation 11, a direct signal portion for an output signal y provides a direct signal and a residual signal, and a diffuse signal portion for the output signal y provides a diffuse signal. Overall, only the direct signal may be processed using GES.

A GES processing result may be determined according to Equation 12.

$$y_{ges}^{n,k}=y_{direct}^{n,k}+y_{diffuse}^{n,k} \quad \text{[Equation 12]}$$

GES may extract an envelope with respect to a downmix signal for performing spatial synthesis aside from an LFE channel depending on a tree structure and a specific channel of an output signal upmixed from the downmix signal by the decoder.

In the N-N/2-N configuration, an output signal $ch_{output}$ may be defined as expressed by Table 2.

TABLE 2

| Configuration | $ch_{output}$ |
|---|---|
| N-N/2-N | $0 \le ch_{out} < 2$ (NumInCh − NumLfe) |

In the N-N/2-N configuration, an input signal $ch_{input}$ may be defined as expressed by Table 3.

TABLE 3

| Configuration | $ch_{input}$ |
|---|---|
| N-N/2-N | $0 \le ch_{input} <$ (NumInCh − NumLfe) |

Also, in the N-N/2-N configuration, a downmix signal $Dch(ch_{output})$ may be defined as expressed by Table 4.

TABLE 4

| Configuration | bsTreeConfig | $Dch(ch_{ouput})$ |
|---|---|---|
| N-N/2-N | 7 | $Dch(ch_{output}) = d$, if $ch_{output} \in \{ch_{2d}, ch_{2d+1}\}_d$ with: $0 \le d <$ (NumInCh − NumLfe) |

Hereinafter, the matrix M1 ($M_1^{n,k}$) and the matrix M2 ($M_2^{n,k}$) defined with respect to all of time slots n and all of hybrid subbands k will be described. The matrices are the interpolated version of $R_1^{l,m}G_1^{l,m}H^{l,m}$ and $R_2^{l,m}$ defined with respect to a given parameter time slot l and a given processing band n based on channel level difference (CLD), ICC, and CPC parameters valid for a parameter time slot and a processing band.

<Definition of Matrix M1 (pPre-matrix)>

A process of inputting a downmix signal to decorrelators used at the decoder in the N-N/2-N configuration of FIG. 8 will be described using $M_1^{n,k}$ corresponding to the matrix M1. The matrix M1 may be expressed as a pre-matrix.

A size of the matrix M1 depends on the number of channels of a downmix signal input to the matrix M1 and the number of decorrelators used at the decoder. Here, elements of the matrix M1 may be derived from CLD and/or CPC parameters. The matrix M1 may be defined by Equation 13.

[Equation 13]

$$M_1^{n,k}=\begin{cases} W_1^{l,k}\alpha(n,l)+(1-\alpha(n,l))W_1^{-1,k}, & 0\le n\le t(l),\ l=0 \\ W_1^{l,k}\alpha(n,l)+(1-\alpha(n,l))W_1^{l-1,k}, & t(l-1)<n\le t(l),\ 1\le l<L \end{cases}$$

$$\text{for } 0\le l<L,\ 0\le k<K$$

In Equation 13, $$\alpha(n,l)=\begin{cases} \dfrac{n+1}{t(l)+1}, & l=0 \\ \dfrac{n-t(l-1)}{t(l)-t(l-1)}, & \text{otherwise} \end{cases}.$$

Meanwhile, $W_1^{n,k}$ may be smoothed according to Equation 14.

[Equation 14]

$$W_1^{l,k}=\begin{cases} s_{delta}(l)\cdot W_{konj}^{l,k}+(1-s_{delta}(l))\cdot W_1^{l-1,k}, & S_{proc}(l,\kappa(k))=1 \\ W_{konj}^{l,k}, & S_{proc}(l,\kappa(k))=0 \end{cases}$$

$$W_{temp}^{l,k}=R_1^{l,\kappa(k)}G_1^{l,\kappa(k)}H^{l,\kappa(k)}$$

$$W_{konj}^{l,k}=\kappa_{konj}\left(k,W_{temp}^{l,k}\right) \text{ for } 0\le k<K,\ 0\le l<L$$

In Equation 14, in each of K (k) and $K_{konj}(k,x)$, a first row is a hybrid subband k, a second row is a processing band, and a third row is a complex conjugation x* of x with respect to a specific hybrid subband k. Further, $W_1^{-1,k}$ denotes a last parameter set of a previous frame.

Matrices $R_1^{l,m}$, $G_1^{l,m}$, and $H^{l,m}$ for the matrix M1 may be defined as follows:

(1) Matrix R1:

Matrix may control the number of signals that are input to decorrelators, and may be expressed as a function of CLD and CPS since a decorrelated signal is not added.

The matrix $R_1^{l,m}$ may be differently defined based on a channel configuration. In the N-N/2-N configuration, all of input signal channels may be input in pairs to an OTT box to prevent OTT boxes from being cascaded. In the N-N/2-N configuration, the number of OTT boxes is N/2.

In this case, the matrix $R_1^{l,m}$ depends on the number of OTT boxes equal to a column size of the vector $X^{n,k}$ that includes an input signal. However, LFE upmix based on an OTT box does not require a decorrelator and thus, is not considered in the N-N/2-N configuration. All of elements of the matrix $R_1^{l,m}$ may be either 1 or 0.

In the N-N/2-N configuration, the matrix $R_1^{l,m}$ may be defined by Equation 15.

$$R_1^{l,m}=\left[\frac{I_{NumInCh}}{I_{NumInCh-NumLfe}}\right],\ 0\le m<M_{proc},\ 0\le l<L \quad \text{[Equation 15]}$$

In the N-N/2-N configuration, all of the OTT boxes represent parallel processing stages instead of cascade. Accordingly, in the N-N/2-N configuration, none of the OTT boxes are connected to other OTT boxes. The matrix $R_1^{l,m}$ may be configured using unit matrix $I_{NumInCh}$ and unit matrix $I_{NumInCh-NumLfe}$. Here, unit matrix $I_N$ may be a unit matrix with the size of N*N.

(2) Matrix GI:

To handle a downmix signal or a downmix signal supplied from an outside prior to MPS decoding, a data stream controlled based on correction factors may be applicable. A correction factor may be applicable to the downmix signal or the downmix signal supplied from the outside, based on matrix $G_1^{l,m}$.

In Equation 17, $g_X^{l,m}=G(X,l,m,)$, $0 \le X < NumInCh$, $0 \le m < M_{proc}$, $0 \le l < L$.

Meanwhile, if residual coding based on the external downmix compensation is applied in the N-N/2-N configuration (bsArbitraryDownmix=2), the matrix $G_1^{l,m}$ may be defined by Equation 18:

[Equation 18]

$$G_1^{l,m} = \begin{cases} \left[\begin{array}{ccccc} \alpha \cdot g_0^{l,m} & 0 & \dots & 0 & 0 \\ 0 & \alpha \cdot g_1^{l,m} & 0 & \dots & 0 \\ \vdots & 0 & \ddots & 0 & \vdots \\ 0 & \dots & 0 & \alpha \cdot g_{NumInCh-2}^{l,m} & 0 \\ 0 & 0 & \dots & 0 & \alpha \cdot g_{NumInCh-1}^{l,m} \end{array}\right] I_{NumInCh}, & m \le m_{ArtDmxRes}(i) \\ \left[\begin{array}{ccccc} g_0^{l,m} & 0 & \dots & 0 & 0 \\ 0 & g_1^{l,m} & 0 & \dots & 0 \\ \vdots & 0 & \ddots & 0 & \vdots \\ 0 & \dots & 0 & g_{NumInCh-2}^{l,m} & 0 \\ 0 & 0 & \dots & 0 & g_{NumInCh-1}^{l,m} \end{array}\right] O_{NumInCh}, & \text{otherwise} \end{cases}$$

$$\underbrace{\qquad\qquad}_{NumInCh \times NumInCh}$$

The matrix $G_1^{l,m}$ may guarantee that a level of a downmix signal for a specific time/frequency tile represented by a parameter is equal to a level of a downmix signal obtained when an encoder estimates a spatial parameter.

It can be classified into three cases; (i) a case in which external downmix compensation is absent (bsArbitraryDownmix=0) (ii) a case in which parameterized external downmix compensation is present (bsArbitraryDownmix=1), and (iii) residual coding based on external downmix compensation is performed (bsArbitraryDownmix=2). If bsArbitraryDownmix=1, the decoder does not support the residual coding based on the external downmix compensation.

If the external downmix compensation is not applied in the N-N/2-N configuration (bsArbitraryDownmix=0), the matrix $G_1^{l,m}$ in the N-N/2-N configuration may be defined by Equation 16.

$$G_1^{l,m}=[I_{NumInCh}|O_{NumInCh}] \quad \text{[Equation 16]}$$

In Equation 16, $I_{NumInCl}$ denotes a unit matrix that indicates a size of NumInCh* NumInCh and $O_{NumInCh}$ denotes a zero matrix that indicates a size of NumInCh*NumInCh.

On the contrary, if the external downmix compensation is applied in the N-N/2-N configuration (bsArbitraryDownmix=1), the matrix $G_1^{l,m}$ in the N-N/2-N configuration may be defined by Equation 17:

[Equation 17]

$$G_1^{l,m} = \left[\begin{array}{ccccc} g_0^{l,m} & 0 & \dots & 0 & 0 \\ 0 & g_1^{l,m} & 0 & \dots & 0 \\ \vdots & 0 & \ddots & 0 & \vdots \\ 0 & \dots & 0 & g_{NumInCh-2}^{l,m} & 0 \\ 0 & 0 & \dots & 0 & g_{NumInCh-1}^{l,m} \end{array}\right] O_{NumInCh}$$

$$\underbrace{\qquad\qquad}_{NumInCh \times NumInCh}$$

In Equation 18, $g_X^{l,m}=G(X,l,m)$, $0 \le X < NumInCh$, $0 \le m < M_{proc}$, $0 \le l < L$, and $\alpha$ may be updated.

(3) Matrix H1:

In the N-N/2-N configuration, the number of downmix signal channels may be 5 or more. Accordingly, inverse matrix H may be a unit matrix having a size corresponding to the number of columns of vector $X^{n,k}$ of an input signal with respect to all of parameter sets and processing bands.

<Definition of Matrix M2 (post-matrix)>

In the N-N/2-N configuration, $M_2^{n,k}$ that is the matrix M2 defines a combination between a direct signal and a decorrelated signal in order to generate a multi-channel output signal. $M_2^{n,k}$ may be defined by Equation 19:

[Equation 19]

$$M_2^{n,k} = \begin{cases} W_2^{l,k}\alpha(n,l) + (1-\alpha(n,l))W_2^{-1,k}, & 0 \le n \le t(l),\ l = 0 \\ W_2^{l,k}\alpha(n,l) + (1-\alpha(n,l))W_2^{l-1,k}, & t(l-1) < n \le t(l),\ 1 \le l < L \end{cases}$$

$$\text{for } 0 \le l \le L,\ 0 \le k < K$$

In Equation 19, $$\alpha(n,l) = \begin{cases} \dfrac{n+1}{t(l)+1}, & l = 0 \\ \dfrac{n-t(l-1)}{t(l)-t(l-1)}, & \text{otherwise} \end{cases}.$$

Meanwhile, $W_2^{l,k}$ may be smoothed according to Equation 20.

$$W_2^{l,k} = \begin{cases} s_{delta}(l) \cdot R_2^{l,\kappa(k)} + (1 - s_{delta}(l)) \cdot W_2^{l-1,k}, & S_{proc}(l, \kappa(k)) = 1 \\ R_2^{l,\kappa(k)}, & S_{proc}(l, \kappa(k)) = 0 \end{cases} \quad \text{[Equation 20]}$$

In Equation 20, in each of K(k) and $K_{konj}$(k,x), a first row is a hybrid subband k, a second row is a processing band, and a third row is a complex conjugation x* of x with respect to a specific hybrid subband k. Further, $W_2^{-1,k}$ denotes a last parameter set of a previous frame.

An element of the matrix $R_2^{n,k}$ for the matrix M2 may be calculated from an equivalent model of an OTT box. The OTT box includes a decorrelator and a mixing processor. A mono input signal input to the OTT box may be transferred to each of the decorrelator and the mixing processor. The mixing processor may generate a stereo output signal based on the mono input signal, a decorrelated signal output through the decorrelator, and CLD and ICC parameters. Here, CLD controls localization in a stereo field and ICC controls a stereo wideness of an output signal.

A result output from an arbitrary OTT box may be defined by Equation 21.

$$\begin{bmatrix} y_0^{l,m} \\ y_1^{l,m} \end{bmatrix} = H \begin{bmatrix} x^{l,m} \\ q^{l,m} \end{bmatrix} = \begin{bmatrix} H11_{OTT_x}^{l,m} & H12_{OTT_x}^{l,m} \\ H21_{OTT_x}^{l,m} & H22_{OTT_x}^{l,m} \end{bmatrix} \begin{bmatrix} x^{l,m} \\ q^{l,m} \end{bmatrix} \quad \text{[Equation 21]}$$

The OTT box may be labeled with $OTT_x$ where 0≤X<numOttBoxes, and each of $H11_{OTT_x}^{l,m}$ . . . $H22_{OTT_x}^{l,m}$ denotes an element of the arbitrary matrix in a time slot l and a parameter band n with respect to the OTT box.

$$R_2^{l,m} = \begin{bmatrix} \begin{bmatrix} H11_{OTT_0}^{l,m}(n) & H12_{OTT_0}^{l,m}(n) \\ H21_{OTT_0}^{l,m}(n) & H22_{OTT_0}^{l,m}(n) \end{bmatrix} & O_2 & \cdots & O_2 \\ O_2 & \ddots & & \\ \vdots & & \begin{bmatrix} H11_{OTT_i}^{l,m}(n) & H12_{OTT_i}^{l,m}(n) \\ H21_{OTT_i}^{l,m}(n) & H22_{OTT_i}^{l,m}(n) \end{bmatrix} & \vdots \\ & & \ddots & O_2 \\ O_2 & \cdots & O_2 & \begin{bmatrix} H11_{OTT_{numOttBoxes-1}}^{l,m}(n) & H12_{OTT_{numOttBoxes-1}}^{l,m}(n) \\ H21_{OTT_{numOttBoxes-1}}^{l,m}(n) & H22_{OTT_{numOttBoxes-1}}^{l,m}(n) \end{bmatrix} \end{bmatrix} \quad \text{[Equation 23]}$$

Here, a post gain matrix may be defined by Equation 22.

$$\begin{bmatrix} H11_{OTT_x}^{l,m} & H12_{OTT_x}^{l,m} \\ H21_{OTT_x}^{l,m} & H22_{OTT_x}^{l,m} \end{bmatrix} = \begin{cases} \begin{bmatrix} c_{1,X}^{l,m}\cos(\alpha_X^{l,m} + \beta_X^{l,m}) & 1 \\ c_{2,X}^{l,m}\cos(-\alpha_X^{l,m} + \beta_X^{l,m}) & -1 \end{bmatrix}, & m < resBands_x \\ \begin{bmatrix} c_{1,X}^{l,m}\cos(\alpha_X^{l,m} + \beta_X^{l,m}) \\ c_{2,X}^{l,m}\cos(-\alpha_X^{l,m} + \beta_X^{l,m}) \\ c_{1,X}^{l,m}\sin(\alpha_X^{l,m} + \beta_X^{l,m}) \\ c_{2,X}^{l,m}\sin(-\alpha_X^{l,m} + \beta_X^{l,m}) \end{bmatrix}, & \text{otherwise} \end{cases} \quad \text{[Equation 22]}$$

In Equation 22, $$c_{1,X}^{l,m} = \sqrt{\frac{10^{\frac{CLD_X^{l,m}}{10}}}{1 + 10^{\frac{CLD_X^{l,m}}{10}}}}, \quad c_{2,X}^{l,m} = \sqrt{\frac{1}{1 + 10^{\frac{CLD_X^{l,m}}{10}}}},$$

$$\beta_X^{l,m} = \arctan\left(\tan(\alpha_X^{l,m})\frac{c_{2,X}^{l,m} - c_{1,X}^{l,m}}{c_{2,X}^{l,m} - c_{1,X}^{l,m}}\right), \text{ and } \alpha_X^{l,m} = \frac{1}{2}\arccos(\rho_X^{l,m}).$$

Meanwhile, $$\rho_X^{l,m} = \begin{cases} \max\left\{ICC_X^{l,m}, \lambda_0\left(10^{\frac{CLD_X^{l,m}}{20}} + 10^{\frac{-CLD_X^{l,m}}{20}}\right)\right\}, & m < resBands_x \\ ICC_X^{l,m}, & \text{otherwise} \end{cases}$$

where $\lambda_0 = -11/72$ for $0 \le m < M_{proc}, 0 \le l < L$.

Further, $$resBands_x = \begin{cases} m_{resProc}(X), & bsResidualPresent(X) = 1, bsResidualCoding = 1 \\ 0, & \text{otherwise} \end{cases}.$$

Here, in the N-N/2-N configuration, $R_2^{l,m}$ may be defined by Equation 23.

In Equation 23, CLD and ICC may be defined by Equation 24.

$$CLD_x^{l,m} = D_{CLD}(X,l,m)$$

$$ICC_x^{l,m} = D_{ICC}(X,l,m) \quad \text{[Equation 24]}$$

In Equation 24, 0≤X<NumInCh,0≤m<$M_{proc}$,0≤l<L.

<Definition of Decorrelator>

In the N-N/2-N configuration, decorrelators may be executed by reverberation filters in a QMF subband domain. The reverberation filters may represent different filter characteristics based on a current corresponding hybrid subband among all of hybrid subbands.

A reverberation filter refers to an imaging infrared (IIR) lattice filter. IIR lattice filters have different filter coefficients with respect to different decorrelators in order to generate mutually decorrelated orthogonal signals.

A decorrelation process performed by a decorrelator may proceed through a plurality of processes. Initially, $v^{n,k}$ that is an output of the matrix M1 is input to an all-pass decorrelation filter set. Filtered signals may be energy-shaped. Here, energy shaping indicates shaping a spectral or temporal envelope so that decorrelated signals may be matched to be further closer to input signals.

The input signal $v_X^{n,k}$ input to an arbitrary decorrelator is a portion of the vector $v^{n,k}$. To guarantee orthogonality between decorrelated signals derived through a plurality of decorrelators, the plurality of decorrelators has different filter coefficients.

Due to constant frequency-dependent delay, a decorrelator filter includes a plurality of all-pass IIR areas. A frequency axis may be divided into different areas to correspond to QMF divisional frequencies. For each area, a length of delay and lengths of filter coefficient vectors are same. A filter coefficient of a decorrelator having fractional delay due to additional phase rotation depends on a hybrid subband index.

As described above, filters of a decorrelator have different filter coefficients to guarantee orthogonality between decorrelated signals that are output from the decorrelators. In the N-N/2-N configuration, N/2 decorrelators are required. Here, in the N-N/2-N configuration, the number of decorrelators may be limited to 10. In the N-N/2-N configuration in which an LFE mode is absent, if N/2, i.e., the number of OTT boxes exceeds 10, the number of decorrelators corresponding to the number of OTT boxes exceeding 10 may be reused according to a 10-basis modulo operation.

Table 5 shows an index of a decorrelator in the decoder of the N-N/2-N configuration. Referring to Table 5, indices of N/2 decorrelators are repeated based on a unit of "10". That is, a zero-th decorrelator and a tenth decorrelator have the same index of $D_1^{OTT}$ ( ). In detail, if N, i.e., the number of output signal channels exceeds M corresponding to a preset number of channels, the decorrelator may include a first decorrelator corresponding to a channel of M or less and a second decorrelator corresponding to a channel greater than M. The second decorrelator may reuse a filter set of the first decorrelator.

TABLE 5

| | Decorrelator X = 0, . . . , rem (N/2-1, 10) | | | | | | | | |
|---|---|---|---|---|---|---|---|---|---|
| configuration | 0 | 1 | 2 | . . . | 9 | 10 | 11 | . . . | N/2-1 |
| N-N/2-N | $D_0^{OTT}$ ( ) | $D_1^{OTT}$ ( ) | $D_2^{OTT}$ ( ) | . . . | $D_9^{OTT}$ ( ) | $D_0^{OTT}$ ( ) | $D_1^{OTT}$ ( ) | . . . | $D_{mod(N/2-1,\ 10)}^{OTT}$ ( ) |

The N-N/2-N configuration may be configured based on syntax as expressed by Table 6.

TABLE 6

| Syntax | No. of bits | Mnemonic |
|---|---|---|
| SpatialSpecificConfig( ) | | |
| { | | |
| bsSamplingFrequencyIndex; | 4 | uimsbf |
| if ( bsSamplingFrequencyIndex == 0xf ) { | | |
| bsSamplingFrequency; | 24 | uimsbf |
| } | | |
| bsFrameLength; | 7 | uimsbf |
| bsFreqRes; | 3 | uimsbf |
| bsTreeConfig; | 4 | uimsbf |
| if (bsTreeConfig == '0111') { | | |
| bsNumInCh; | 4 | uimsbf |
| bsNumLFE | 2 | uimsbf |
| bsHasSpeakerConfig | 1 | uimsbf |
| if ( bsHasSpeakerConfig == 1) { | | |

TABLE 6-continued

| Syntax | No. of bits | Mnemonic |
|---|---|---|
| audioChannelLayout = SpeakerConfig3d( ); | | Note 1 |
| } | | |
| } | | |
| bsQuantMode; | 2 | uimsbf |
| bsOneIcc; | 1 | uimsbf |
| bsArbitraryDownmix; | 1 | uimsbf |
| bsFixedGainSur; | 3 | uimsbf |
| bsFixedGainLFE; | 3 | uimsbf |
| bsFixedGainDMX; | 3 | uimsbf |
| bsMatrixMode; | 1 | uimsbf |
| bsTempShapeConfig; | 2 | uimsbf |
| bsDecorrConfig; | 2 | uimsbf |
| bs3DaudioMode; | 1 | uimsbf |
| if ( bsTreeConfig == '0111' ) { | | |
| for (i=0; i< NumInCh − NumLfe; i++) { | | |
| defaultCld[i] = 1; | | |
| ottModelfe[i] = 0; | | |
| } | | |
| for (i= NumInCh − NumLfe; i< NumInCh; i++) { | | |
| defaultCld[i] = 1; | | |
| ottModelfe[i] = 1; | | |
| } | | |
| } | | |
| for (i=0; i<numOttBoxes; i++) { | | Note 2 |
| OttConfig(i); | | |
| } | | |
| for (i=0; i<numTttBoxes; i++) { | | Note 2 |
| TttConfig(i); | | |
| } | | |
| if (bsTempShapeConfig == 2) { | | |
| bsEnvQuantMode | 1 | uimsbf |
| } | | |
| if (bs3DaudioMode) { | | |
| bs3DaudioHRTFset; | 2 | uimsbf |
| if (bs3DaudioHRTFset==0) { | | |
| ParamHRTFset( ); | | |
| } | | |
| } | | |

TABLE 6-continued

| Syntax | No. of bits | Mnemonic |
|---|---|---|
| ByteAlign( ); | | |
| SpatialExtensionConfig( ); | | |
| } | | |

Note 1:

SpeakerConfig3d( ) is defined in ISO/IEC 23008-3:2015, Table 5.

Note 2:

numOttBoxes and numTttBoxes are defined by Table 9.2 dependent on bsTreeConfig.

Here, bsTreeConfig may be expressed by Table 7. Table 7 shows a configuration of a decoding apparatus in the N-N/2-N configuration if bsTreeConfig=7. The number (numOttBoxes) of OTT boxes is equal to the number of downmix signal channels (NumInCh). The number of OTT boxes is zero.

TABLE 7

| bsTreeConfig | Meaning |
|---|---|
| 0, 1, 2, 3, 4, 5, 6 | Identical meaning of Table 40 in ISO/IEC 20003-1: 2007 |
| 7 | N-N/2-N configuration<br>numOttBoxes = NumInCh<br>numTttBoxes = 0<br>numInChan = NumInCh<br>numOutChan = NumOutCh<br>output channel ordering is according to Table 9.5 |
| 8 . . . 15 | Reserved |

Here, if bsTreeConfig=0,1,2,3,4,5,6, Table 40 of ISO/IEC 20003-1:2007 corresponding to MPS standard is defined by Table 8.

TABLE 8

| bsTreeConfig | Meaning |
|---|---|
| 0 | 5151 configuration<br>numOttBoxes = 5<br>defaultCld[0] = 1<br>defaultCld[1] = 1<br>defaultCld[2] = 0<br>defaultCld[3] = 0<br>defaultCld[4] = 1<br>defaultCld[5] = 0<br>ottModeLfe[0] = 0<br>ottModeLfe[1] = 0<br>ottModeLfe[2] = 0<br>ottModeLfe[3] = 0<br>ottModeLfe[4] = 1<br>numTttBoxes = 0<br>numInChan = 1<br>numOutChan = 6<br>output channel ordering: L, R, C, LFE, Ls, Rs |
| 1 | 5152 configuration<br>numOttBoxes = 5<br>defaultCld[0] = 1<br>defaultCld[1] = 0<br>defaultCld[2] = 1<br>defaultCld[3] = 1<br>defaultCld[4] = 1<br>defaultCld[5] = 0<br>ottModeLfe[0] = 0<br>ottModeLfe[1] = 0<br>ottModeLfe[2] = 1<br>ottModeLfe[3] = 0<br>ottModeLfe[4] = 0<br>numTttBoxes = 0<br>numInChan = 1<br>numOutChan = 6<br>output channel ordering: L, Ls, R, Rs, C, LFE |
| 2 | 525 configuration<br>numOttBoxes = 3<br>defaultCld[0] = 1<br>defaultCld[1] = 1<br>defaultCld[2] = 1<br>defaultCld[3] = 1<br>defaultCld[4] = 0<br>defaultCld[5] = 1<br>defaultCld[6] = 0<br>defaultCld[7] = 0<br>defaultCld[8] = 0<br>ottModeLfe[0] = 1<br>ottModeLfe[1] = 0<br>ottModeLfe[2] = 0<br>numTttBoxes = 1<br>numInChan = 2<br>numOutChan = 6<br>output channel ordering: L, Ls, R, Rs, C, LFE |
| 3 | 7271 configuration 5/2.1)<br>numOttBoxes = 5<br>defaultCld[0] = 1<br>defaultCld[1] = 1<br>defaultCld[2] = 1<br>defaultCld[3] = 1<br>defaultCld[4] = 1<br>defaultCld[5] = 1<br>defaultCld[6] = 0<br>defaultCld[7] = 1<br>defaultCld[8] = 0<br>defaultCld[9] = 0<br>defaultCld[10] = 0<br>ottModeLfe[0] = 1<br>ottModeLfe[1] = 0<br>ottModeLfe[2] = 0<br>ottModeLfe[3] = 0<br>ottModeLfe[4] = 0<br>numTttBoxes = 1<br>numInChan = 2<br>numOutChan = 8<br>output channel ordering: L, Lc, Ls, R, Rc, Rs, C, LFE |
| 4 | 7272 configuration 3/4.1)<br>numOttBoxes = 5<br>defaultCld[0] = 1<br>defaultCld[1] = 1<br>defaultCld[2] = 1<br>defaultCld[3] = 1<br>defaultCld[4] = 1<br>defaultCld[5] = 1<br>defaultCld[6] = 0<br>defaultCld[7] = 1<br>defaultCld[8] = 0<br>defaultCld[9] = 0<br>defaultCld[10] = 0<br>ottModeLfe[0] = 1<br>ottModeLfe[1] = 0<br>ottModeLfe[2] = 0<br>ottModeLfe[3] = 0<br>ottModeLfe[4] = 0<br>numTttBoxes = 1<br>numInChan = 2<br>numOutChan = 8<br>output channel ordering: L, Lsr, Ls, R, Rsr, Rs, C, LFE |
| 5 | 7571 configuration 5/2.1)<br>numOttBoxes = 2<br>defaultCld[0] = 1<br>defaultCld[1] = 1<br>defaultCld[2] = 0<br>defaultCld[3] = 0<br>defaultCld[4] = 0<br>defaultCld[5] = 0<br>defaultCld[6] = 0<br>defaultCld[7] = 0<br>ottModeLfe[0] = 0<br>ottModeLfe[1] = 0<br>numTttBoxes = 0<br>numInChan = 6<br>numOutChan = 8<br>output channel ordering: L, Lc, Ls, R, Rc, Rs, C, LFE |
| 6 | 7572 configuration 3/4.1)<br>numOttBoxes = 2<br>defaultCld[0] = 1<br>defaultCld[1] = 1<br>defaultCld[2] = 0<br>defaultCld[3] = 0<br>defaultCld[4] = 0<br>defaultCld[5] = 0<br>defaultCld[6] = 0<br>defaultCld[7] = 0<br>ottModeLfe[0] = 0<br>ottModeLfe[1] = 0<br>numTttBoxes = 0<br>numInChan = 6<br>numOutChan = 8<br>output channel ordering: L, Lsr, Ls, R, Rsr, Rs, C, LFE |

In the N-N/2-N configuration, the number of downmix signal channels, i.e., bsNumInCh, may be expressed by Table 9.

TABLE 9

| bsnumInCh | NumInCh | NumOutCh |
|---|---|---|
| 0 | 12 | 24 |
| 1 | 7 | 14 |
| 2 | 5 | 10 |
| 3 | 6 | 12 |
| 4 | 8 | 16 |
| 5 | 9 | 18 |
| 6 | 10 | 20 |
| 7 | 11 | 22 |
| 8 | 13 | 26 |
| 9 | 14 | 28 |
| 10 | 15 | 30 |
| 11 | 16 | 32 |
| 12, . . . , 15 | Reserved | Reserved |

Here, NumInCh denotes the number of channels of a downmix signal input to the decoding apparatus in the N-N/2-N configuration, and NumOutCh denotes the number of output signal channels by upmixing the downmix signal. In the N-N/2-N configuration, NLFE, i.e., the number of LFE channels among output signals may be expressed by Table 10. NumLfe denotes the number of LFE channels ($N_{LFE}$) in the N-N/2-N configuration.

TABLE 10

| bsNumLFE | NumLfe |
|---|---|
| 0 | 0 |
| 1 | 1 |
| 2 | 2 |
| 3 | Reserved |

In the N-N/2-N configuration, channel ordering of output signals may be performed based on the number of output signal channels and the number of LFE channels as expressed by Table 11.

TABLE 11

| NumOutCh | NumLfe | Output channel ordering |
|---|---|---|
| 24 | 2 | Rv, Rb, Lv, Lb, Rs, Rvr, Lsr, Lvr, Rss, Rvss, Lss, Lvss, Rc, R, Lc, L, Ts, Cs, Cb, Cvr, C, LFE, Cv, LFE2, |
| 14 | 0 | L, Ls, R, Rs, Lbs, Lvs, Rbs, Rvs, Lv, Rv, Cv, Ts, C, LFE |
| 12 | 1 | L, Lv, R, Rv, Lsr, Lvr, Rsr, Rvr, Lss, Rss, C, LFE |
| 12 | 2 | L, Lv, R, Rv, Ls, Lss, Rs, Rss, C, LFE, Cvr, LFE2 |
| 10 | 1 | L, Lv, R, Rv, Lsr, Lvr, Rsr, Rvr, C, LFE |

Note 1:
All of Names and layouts of loudspeaker is following the naming and position of Table 8 in ISO/IEC 23001-8: 2013/FDAM1.
Note 2:
Output channel ordering for the case of 16, 20, 22, 26, 30, 32 is following the arbitrary order from 1 to N without any specific naming of speaker layouts.
Note 3:
Output channel ordering for the case when bsHasSpeakerConfig == 1 is following the order from 1 to N with associated naming of speaker layouts as specified in Table 94 of ISO/IEC 23008-3: 2015.

In Table 6, bsHasSpeakerConfig denotes a flag indicating whether a layout of an output signal to be played is different from a layout corresponding to channel ordering in Table 11. If bsHasSpeakerConfig==1, audioChannelLayout that is a layout of a loudspeaker for actual play may be used for rendering.

In addition, audioChannelLayout denotes the layout of the loudspeaker for actual play.

If the output signal includes an LFE channel, a channel order of the LFE channel may be determined to satisfy (i) a condition that the LFE channel is processed together with another channel using an OTT box instead of the LFE channel and (ii) a condition that the LFE channel is located at a last position in a channel list. For example, the LFE channel is located at a last position among L, Lv, R, Rv, Ls, Lss, Rs, Rss, C, LFE, Cvr, and LFE2 that are included in the channel list.

Figure 9:
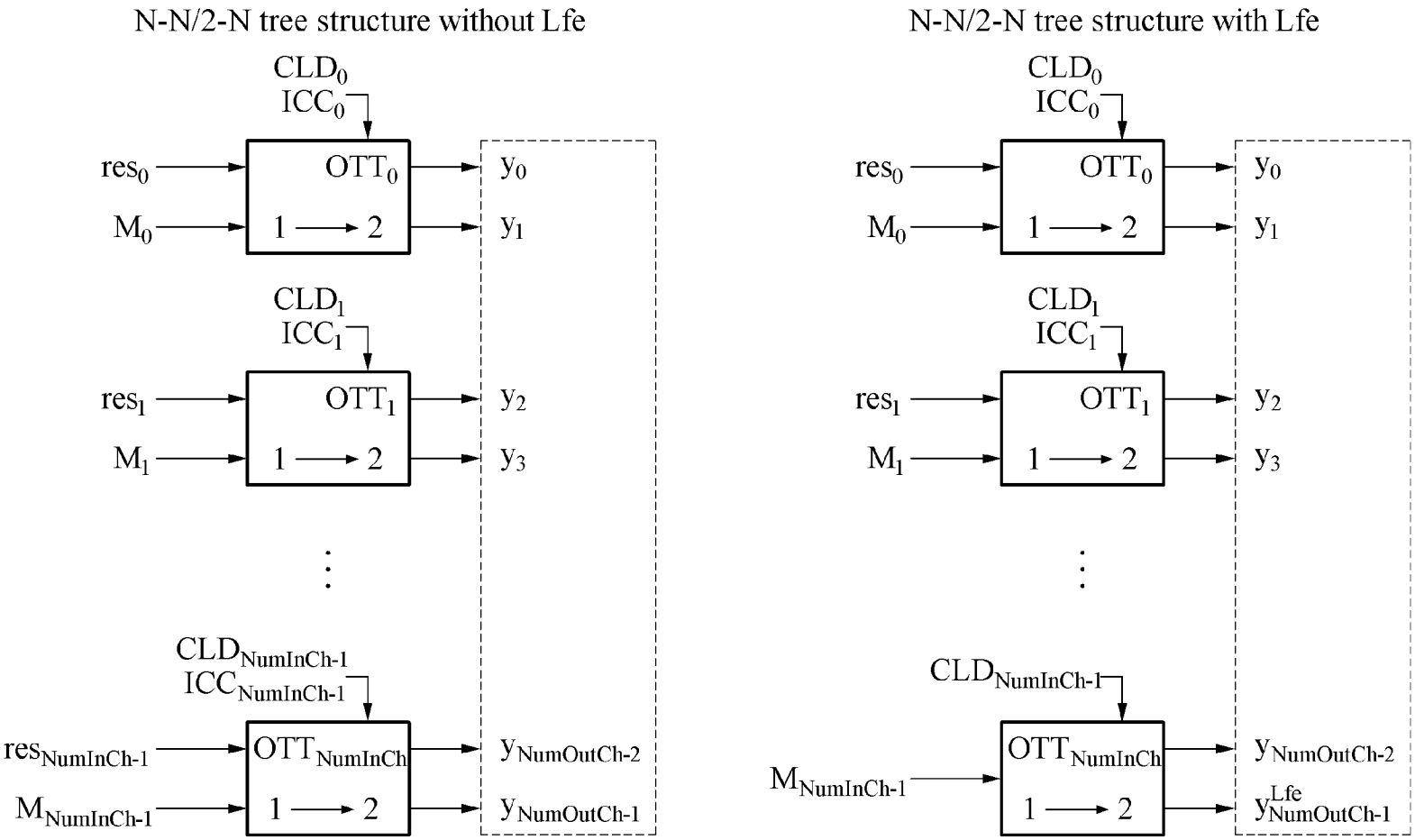
FIG. 9 illustrates a tree structure for performing spatial audio processing for an N-N/2-N configuration according to an example embodiment.

FIG. 9 illustrates a tree structure for performing spatial audio processing for an N-N/2-N configuration according to an example embodiment.

The N-N/2-Nstructure of FIG. 8 may be expressed in the tree structure of FIG. 9. In FIG. 9, all of the OTT boxes may regenerate a 2-channel output signal based on CLD, ICC, a residual signal, and an input signal. An OTT box and CLD, ICC, a residual signal, and an input signal corresponding thereto may be numbered based on order indicated in a bitstream.

Referring to FIG. 9, N/2 OTT boxes are present. Here, a decoder that is a multi-channel audio signal processing apparatus may generate an N-channel output signal from an N/2 channel downmix signal using the N/2 OTT boxes. Here, the N/2 OTT boxes are not configured through a plurality of hierarchs. That is, the OTT boxes may perform parallel upmixing for each of channels of the N/2-channel downmix signal. That is, one OTT box is not connected to another OTT box.

A tree structure on the left of FIG. 9 illustrates an N-N/2-N tree structure in which an LFE channel is not applied and a tree structure on the right of FIG. 9 illustrates an N-N/2-N tree structure in which the LFE channel is applied. All of the OTT boxes illustrated in FIG. 9 may regenerate a 2-channel output signal by upmixing a 1-channel downmix signal M.

If the LFE channel is not included in the N-channel output signal, the N/2 OTT boxes may generate the N-channel output signal using a residual signal (res) and a downmix signal (M). However, if the LFE channel is not included in the N-channel output signal, an OTT box from which the LFE channel is output among the N/2 OTT boxes may use only a downmix signal aside from a residual signal.

In addition, if the LFE channel is included in the N-channel output signal, an OTT box from which the LFE channel is not output among the N/2 OTT boxes may upmix a downmix signal using CLD and ICC and an OTT box from which the LFE channel is output may upmix a downmix signal using only CLD.

If the LFE channel is included in the N-channel output signal, an OTT box from which the LFE channel is not output among the N/2 OTT boxes generates a decorrelated signal through a decorrelator and an OTT box from which the LFE channel is output does not perform a decorrelation process and thus, does not generate a decorrelated signal.

Figure 10:
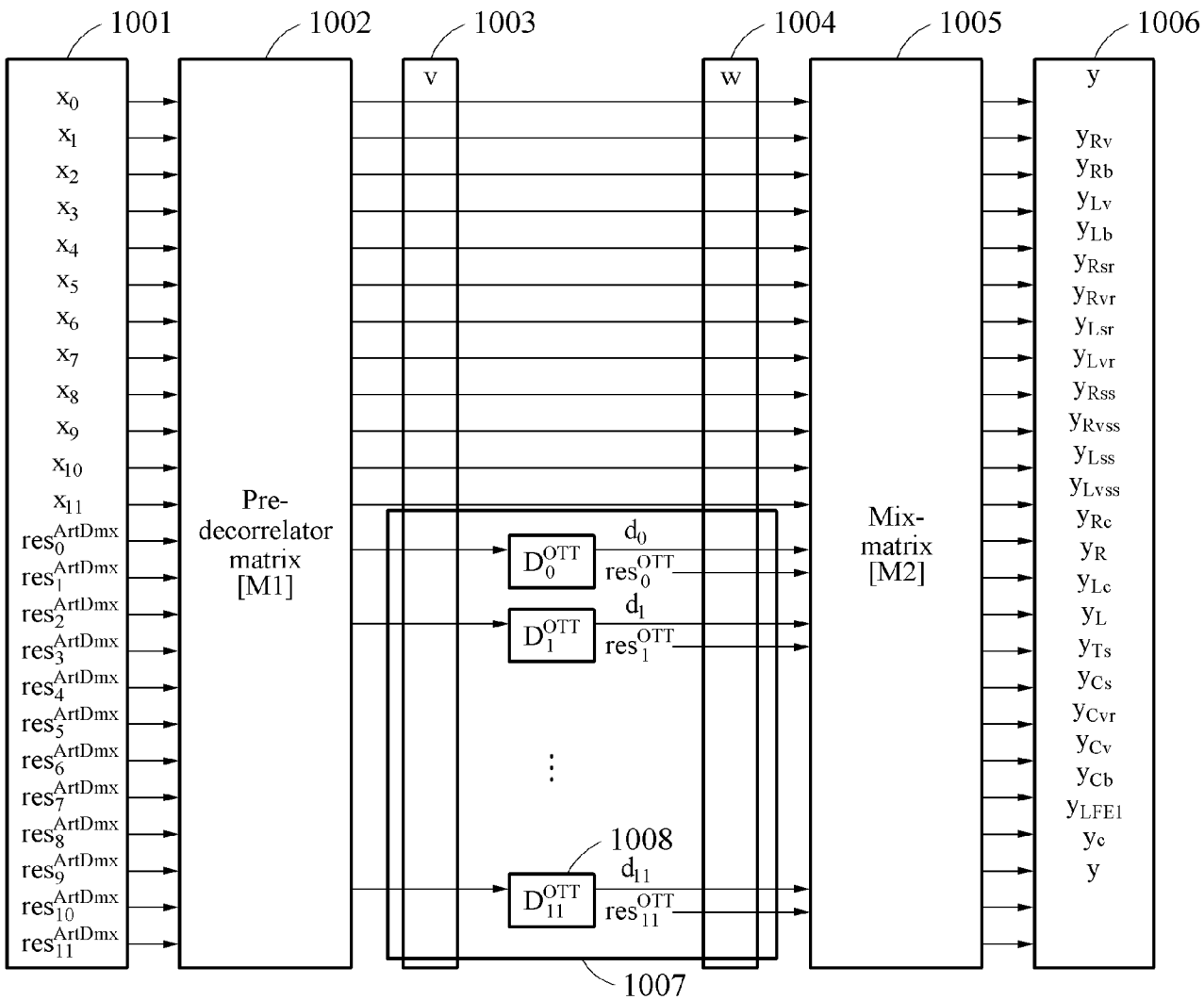
FIG. 10 is a diagram illustrating a process of generating a 24-channel output signal from a 12-channel downmix signal according to an example embodiment.

FIG. 10 illustrates a process of generating a 24-channel output signal from a 12-channel downmix signal according to an example embodiment.

According to an example embodiment, an N/2-channel downmix signal may be generated from an N-channel input signal through MPS encoding. An N-channel output signal may be generated from the N/2-channel downmix signal through MPS decoding.

Although 1 channel, 2 channels, and 5.1 channels may be output as a downmix signal channel through an encoder in the existing MPS standard, the present disclosure is not limited thereto. The definition of additional syntax is required to support the number of downmix signal channels not defined in the existing MPS standard.

In the MPS standard, an input/output relationship may be defined through BsTreeConfig as shown in Table 8. A decoding process of an input signal and an output signal is defined based on BsTreeConfig.

BsTreeConfig 0 defines a process of generating a 1-channel downmix signal from a 6-channel (5.1-channel) input signal, and generating a 6-channel (5.1-channel) output signal from the 1-channel downmix signal. To this end, the decoder requires 5 OTT boxes and CLD may be applicable to each of the OTT boxes.

Here, defaultCLD [0~5] may be defined as CLD that is input to an OTT box based on a position of the OTT box. CLD corresponding to the OTT box is enabled. That is, once the CLD is enabled, the CLD may be input to the OTT box. ottModeLfe also indicates whether an LFE channel is output from the OTT box.

According to Table 8 defined in the current MPS standard, defaultCLD [0~5] corresponding to 6 OTT boxes are defined. The current MPS standard does not cover a case of generating 5 or more channels of a downmix signal where the number of channels of an input signal exceeds 10.

According to an example embodiment, it is possible to process an input signal having the number of channels different from the number of channels defined in the existing MPS standard by applying a reserved bit to the MPS standard. For example, if the number of input signal channels, i.e., N=24 and the number of downmix signal channels=12, definition may be made as shown in Table 12.

TABLE 12

| bsTreeConfig | Meaning |
|---|---|
| 7 (reserved region) | 12-24 configuration<br>numOttBoxes = 12<br>defaultCld[0] = 1<br>defaultCld[1] = 1<br>defaultCld[2] = 1<br>defaultCld[3] = 1<br>defaultCld[4] = 1<br>defaultCld[5] = 1<br>defaultCld[6] = 1<br>defaultCld[7] = 1<br>defaultCld[8] = 1<br>defaultCld[9] = 1<br>ottModeLfe[10] = 1<br>ottModeLfe[11] = 1<br>numTttBoxes = 0<br>numInChan = 12<br>numOutChan = 24<br>output channel ordering: ch1, . . . , ch24 |

The decoder of FIG. 10 is configured according to Table 12. FIG. 10 illustrates a process of generating a 24-channel output signal including two LFE channels from a 12-channel downmix signal ($x_0$ to $x_{11}$).

In FIG. 10, referring to a vector x 1001, 12-channel downmix signals ($x_0$ to $x_{11}$) and 12-channel residual signals ($res_1$ to $res_{11}$) are input. Hereinafter, description will be made by excluding the residual signals. The decoder of FIG. 10 may generate a decorrelated signal by inputting a 12-channel downmix signal to a decorrelator 1007.

A vector v 1003 of FIG. 10 may be derived by applying a matrix M1 1002 to the vector x 1001. The vector v 1003 may be determined according to Equation 25.

[Equation 25]

$$v^{n,k} = M_1^{n,k} x^{n,k} = M_1^{n,k} \begin{bmatrix} x_{M_0}^{n,k} \\ x_{M_2}^{n,k} \\ x_{M_3}^{n,k} \\ x_{M_4}^{n,k} \\ x_{M_5}^{n,k} \\ x_{M_6}^{n,k} \\ x_{M_7}^{n,k} \\ x_{M_8}^{n,k} \\ x_{M_9}^{n,k} \\ x_{M_{10}}^{n,k} \\ x_{M_{11}}^{n,k} \\ x_{res_1^{ArtDmx}}^{n,k} \\ x_{res_2^{ArtDmx}}^{n,k} \\ x_{res_3^{ArtDmx}}^{n,k} \\ \cdots \\ x_{res_{12}^{ArtDmx}}^{n,k} \end{bmatrix} = \begin{bmatrix} v_{M_0}^{n,k} \\ v_{M_1}^{n,k} \\ \cdots \\ \\ \\ \\ \\ v_{M_{12}}^{n,k} \end{bmatrix}$$

Equation 25 corresponds to Equation 1. If a residual signal (res) is absent in Equation 25, $x_{M0}$ to $x_{M11}$ may be mapped to $v_{M0}$ to $v_{M11}$. The same number of decorrelated signals as the number of downmix signals may be derived.

A vector w 1004 may be determined according to Equation 26.

[Equation 26]

$$w^{n,k} = \begin{bmatrix} v_{M_0}^{n,k} \\ \delta_0(k)D_0\left(v_{M_1}^{n,k}\right) + (1-\delta_0(k))v_{res0}^{n,k} \\ \delta_1(k)D_1\left(v_{M_2}^{n,k}\right) + (1-\delta_1(k))v_{res1}^{n,k} \\ \cdots \\ \delta_{11}(k)D_{11}\left(v_{M_{11}}^{n,k}\right) + (1-\delta_2(k))v_{res11}^{n,k} \end{bmatrix} = \begin{bmatrix} w_{M_0}^{n,k} \\ w_0^{n,k} \\ w_1^{n,k} \\ \cdots \\ w_{11}^{n,k} \end{bmatrix}$$

Equation 26 corresponds to Equation 2. The decorrelator 1007 operates if the residual signal is absent. That is, if the residual signal is absent, the decorrelated signal may be generated. D( ) is used when the decorrelator generates the decorrelated signal. In Equation 26, if the residual signal is present, $\delta_i$=0, and otherwise, $\delta_i$=1. That is, if $\delta_i$=1, the decorrelated signal may be generated according to Equation 15.

In FIG. 10, a vector y 1006 may be derived by applying a matrix M2 1005 to the vector w 1004 according to Equation 27. The vector y 1006 corresponds to an N-channel output signal. Here, N=24.

[Equation 27]

$$y^{n,k} = M_2^{n,k} w^{n,k} = M_2^{n,k} \begin{bmatrix} w_{M_0}^{n,k} \\ w_{M_1}^{n,k} \\ w_{M_2}^{n,k} \\ \cdots \\ w_{M_{11}}^{n,k} \end{bmatrix} = \begin{bmatrix} y_{Rv}^{n,k} \\ y_{Rb}^{n,k} \\ \cdots \\ y_{LFE2}^{n,k} \\ y_{Rs}^{n,k} \end{bmatrix}$$

A process of deriving the matrix M1 1002 and the matrix M2 1005 may refer to description of FIG. 8. R1 for deriving the matrix M1 1002 is expressed as Equation 28 and R2 for deriving the matrix M2 1005 is expressed as Equation 29.

$$R_1^{t,m} = \begin{bmatrix} 1 \\ 1 \\ \dots \\ 1 \\ 1 \end{bmatrix}, \quad \text{[Equation 28]}$$

(the number of "1" is 12 and is equal to the number of downmix signal channels)

$$R2 = \begin{bmatrix} R_0(n) & 0 & \dots & & 0 \\ 0 & \ddots & & & \\ \vdots & & R_i(n) & & \vdots \\ & & & \ddots & 0 \\ 0 & & \dots & 0 & R_{M-1}(n) \end{bmatrix} = \begin{bmatrix} \begin{bmatrix} H_{LL}^0(n) & H_{LR}^0(n) \\ H_{RL}^0(n) & H_{RR}^0(n) \end{bmatrix} & 0 & \dots & & 0 \\ 0 & \ddots & & & \\ \vdots & & \begin{bmatrix} H_{LL}^i(n) & H_{LR}^i(n) \\ H_{RL}^i(n) & H_{RR}^i(n) \end{bmatrix} & & \vdots \\ & & & \ddots & 0 \\ 0 & & \dots & 0 & \begin{bmatrix} H_{LL}^{M-1}(n) & H_{LR}^{M-1}(n) \\ H_{RL}^{M-1}(n) & H_{RR}^{M-1}(n) \end{bmatrix} \end{bmatrix} \quad \text{[Equation 29]}$$

In Equation 29, $H_{LL}$, $H_{LR}$, $H_{RL}$, and $H_{RR}$ may be derived from CLD and ICC corresponding to each OTT box.

Herein, proposed is a parallel OTT-based MPS decoder that may generate an N-channel output signal from an N/2-channel downmix signal based on newly defined BsTreeConfig information.

Figure 11:
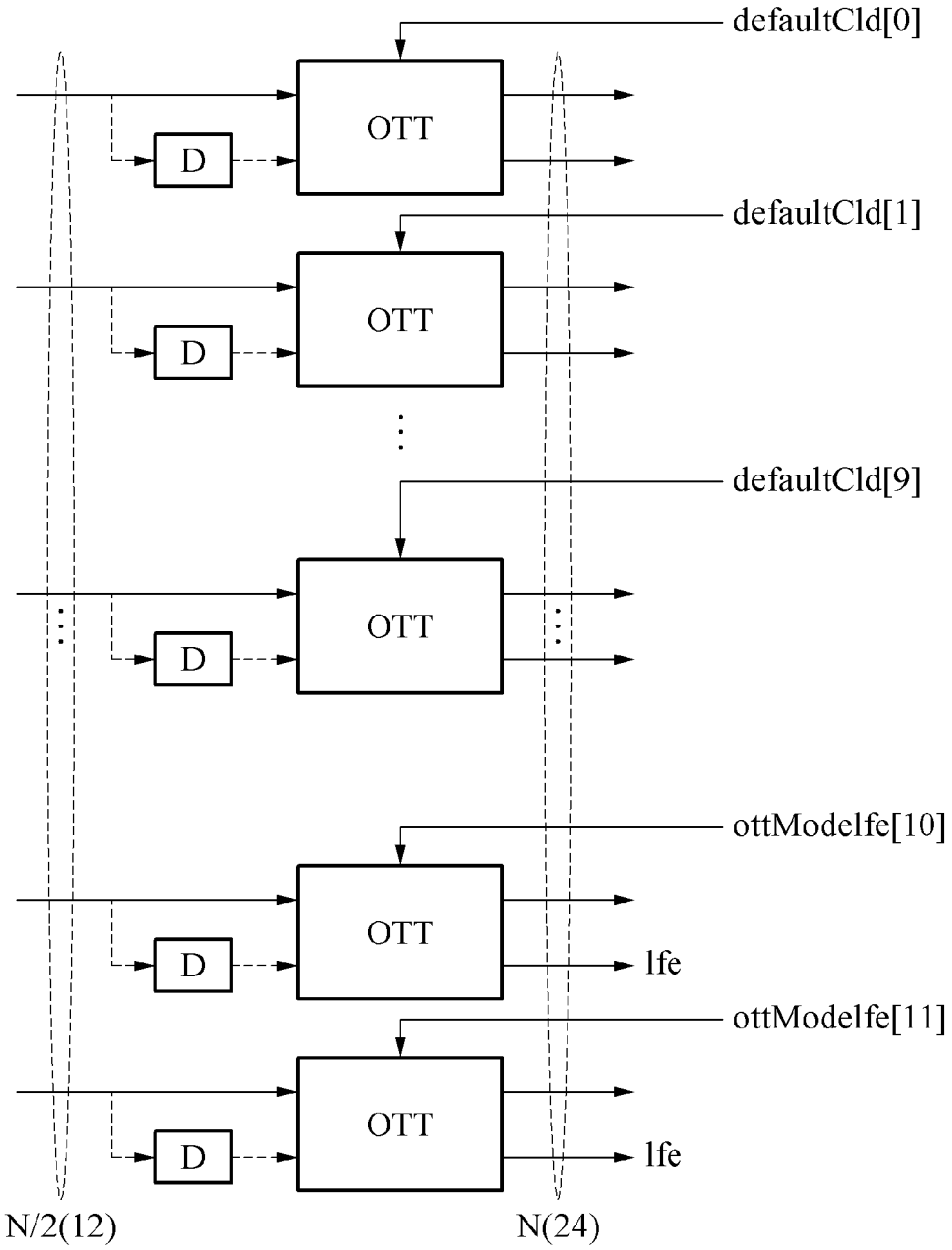
FIG. 11 illustrates an example of a process of FIG. 10 represented in a one-to-two (OTT) box according to an example embodiment.

FIG. 11 illustrates the process of FIG. 10 expressed in an OTT box according to an example embodiment.

Referring to FIG. 11, each OTT box generates a 2-channel signal using a 1-channel downmix signal and a decorrelated signal generated using a decorrelator D. defaultCld[0] to defaultCld[9] corresponding to CLD and OttModelfe[0] and OttModelfe[1] corresponding to an LFE channel may be input to the OTT boxes. For example, if an output signal includes 22.2 channels, an LFE channel may be included in the output signal. In this case, OttModelfe[0] and OttModelfe[1] are enabled.

Figure 12:
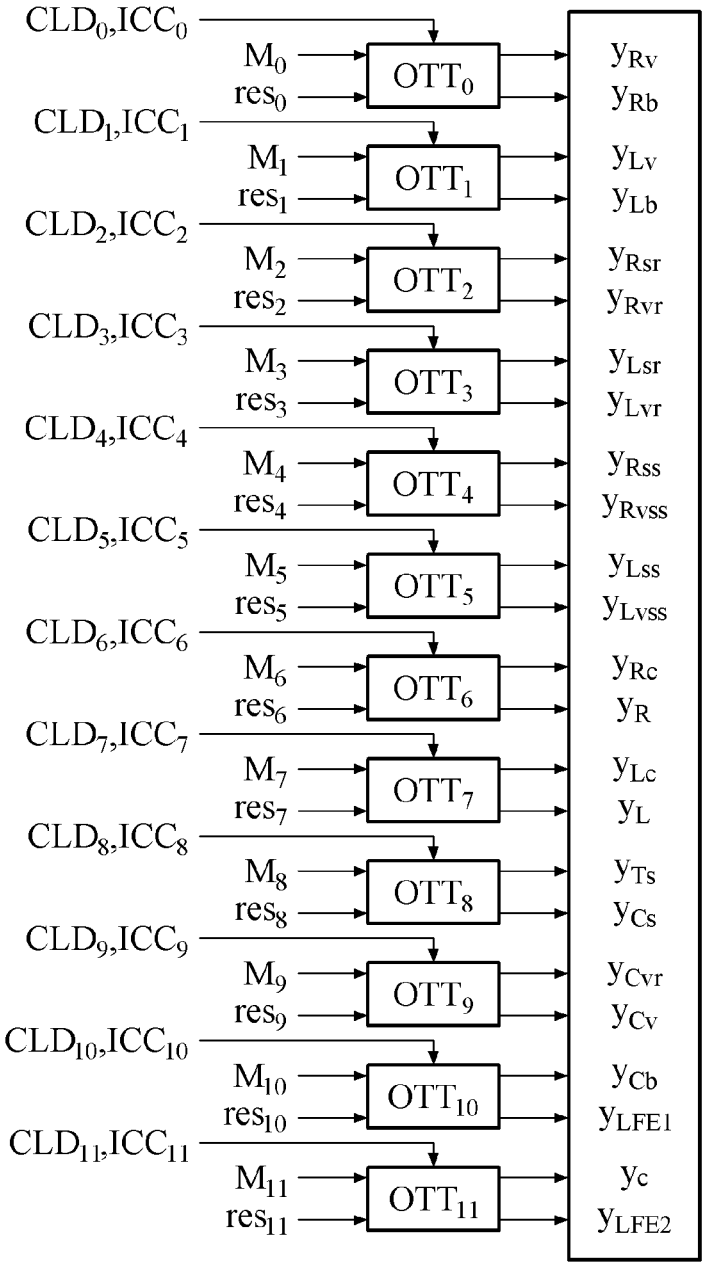
FIG. 12 illustrates an example of a process of FIG. 11 represented in an MPEG Surround (MPS) standard according to an example embodiment.

FIG. 12 illustrates the process of FIG. 11 expressed based on the MPS standard according to an example embodiment.

FIG. 12 illustrates an example in which 12-channel downmix signals $M_0$ to $M_{11}$ are input to the respective OTT boxes. A 24-channel output signal y is generated. Here, CLD and ICC are also input to each OTT box. FIG. 12 illustrates an example in which the residual signal is input to the OTT box. If the residual signal is absent, a decorrelated signal generated from a downmix signal through a decorrelator may be input to the OTT box instead of the residual signal.

A multichannel audio signal processing method according to an example embodiment may include identifying a residual signal and an N/2-channel downmix signal generated from an N-channel input signal; applying the N/2-channel downmix signal and the residual signal to a first matrix; outputting a first signal input to N/2 decorrelators corresponding to N/2 OTT boxes through the first matrix and a second signal transferred to a second matrix instead of being input to the N/2 decorrelators; outputting a decorrelated signal from the first signal through the N/2 decorrelators; applying the decorrelated signal and the second signal to the second matrix; and generating an N-channel output signal through the second matrix.

If an LFE channel is not included in the N-channel output signal, the N/2 decorrelators may correspond to the N/2 OTT boxes, respectively.

If the number of decorrelators exceeds a reference value of a modulo operation, an index of a decorrelator may be repeatedly reused based on the reference value.

If the LFE channel is included in the N-channel output signal, the number of decorrelators corresponding to a remaining number excluding the number of LFE channels from N/2 may be used. The LFE channel may not use the decorrelator of the OTT box.

If a temporal shaping tool is not used, a single vector that includes the second signal, the decorrelated signal derived from the decorrelator, and the residual signal derived from the decorrelator may be input to the second matrix.

Conversely, if the temporal shaping tool is used, a vector corresponding to a direct signal including the second signal and the residual signal derived from the decorrelator and a vector corresponding to a diffuse signal including the decorrelated signal derived from the decorrelator may be input to the second matrix.

The generating of the N-channel output signal may include shaping a temporal envelope of an output signal by applying a scale factor according to the diffuse signal and the direct signal to a diffuse signal portion of the output signal if an STP is used.

The generating of the N-channel output signal may include flattening and reshaping an envelope with respect to a direct signal portion for each channel of the N-channel output signal if GES is used.

A size of the first matrix may be determined based on the number of decorrelators and the number of downmix signal channels used to apply the first matrix, and an element of the first matrix may be determined based on a CLD parameter or a CPC parameter.

A multichannel audio signal processing method according to an example embodiment may include identifying an N/2-channel downmix signal and an N/2-channel residual signal; generating an N-channel output signal by inputting the N/2-channel downmix signal and the N/2-channel residual signal to each of the N/2 OTT boxes. Here, the N/2 OTT boxes are disposed in parallel without mutual connection. Among the N/2 OTT boxes, an OTT box from which an LFE channel is output (1) receives only a downmix signal aside from a residual signal, (2) uses a CLD parameter between the CLD parameter and an ICC parameter, and (3) does not output a decorrelated signal through a decorrelator.

A multichannel signal processing apparatus according to an example embodiment includes a processor to implement a multichannel signal processing method, and the multichannel signal processing method may include identifying a residual signal and an N/2-channel downmix signal generated from an N-channel input signal; applying the N/2-channel downmix signal and the residual signal to a first matrix; outputting a first signal input to N/2 decorrelators corresponding to N/2 OTT boxes through the first matrix and a second signal transferred to a second matrix instead of being input to the N/2 decorrelators; outputting a decorrelated signal from the first signal through the N/2 decorrelators; applying the decorrelated signal and the second signal to a second matrix; and generating an N-channel output signal through the second matrix.

If an LFE channel is not included in the N-channel output signal, the N/2 decorrelators may correspond to the N/2 OTT boxes, respectively.

If the number of decorrelators exceeds a reference value of a modulo operation, an index of a decorrelator may be repeatedly reused based on the reference value. If the LFE channel is included in the N-channel output signal, the number of decorrelators corresponding to a remaining number excluding the number of LFE channels from N/2 may be used. The LFE channel may not use the decorrelator of the OTT box.

If a temporal shaping tool is not used, a single vector that includes the second signal, the decorrelated signal derived from the decorrelator, and the residual signal derived from the decorrelator may be input to the second matrix.

Conversely, if the temporal shaping tool is used, a vector corresponding to a direct signal including the second signal and the residual signal derived from the decorrelator and a vector corresponding to a diffuse signal including the decorrelated signal derived from the decorrelator may be input to the second matrix.

The generating of the N-channel output signal may include shaping a temporal envelope of an output signal by applying a scale factor according to the diffuse signal and the direct signal to a diffuse signal portion of the output signal if an STP is used.

The generating of the N-channel output signal may include flattening and reshaping an envelope with respect to a direct signal portion for each channel of the N-channel output signal if GES is used.

A size of the first matrix may be determined based on the number of decorrelators and the number of downmix signal channels used to apply the first matrix, and an element of the first matrix may be determined based on a CLD parameter or a CPC parameter.

A multichannel signal processing apparatus according to another example embodiment includes a processor to perform a multichannel signal processing method, and the multichannel signal processing method may include identifying an N/2-channel downmix signal and an N/2-channel residual signal; generating an N-channel output signal by inputting the N/2-channel downmix signal and the N/2-channel residual signal to each of the N/2 OTT boxes.

Here, the N/2 OTT boxes are disposed in parallel without mutual connection. Among the N/2 OTT boxes, an OTT box that outputs an LFE channel (1) receives only a downmix signal aside from a residual signal, (2) uses a CLD parameter between the CLD parameter and an ICC parameter, and (3) does not output a decorrelated signal through a decorrelator.

The embodiments described herein may be implemented using hardware components, software components, and/or combination of hardware components and software components. For example, the processing device(s) described herein may include a processor, a controller and an arithmetic logic unit (ALU), a digital signal processor, a microcomputer, a field programmable array (FPA), a programmable logic unit (PLU), a microprocessor or any other device capable of responding to and executing instructions in a defined manner. The processing device may run an operating system (OS) and one or more software applications that run on the OS. The processing device also may access, store, manipulate, process, and create data in response to execution of the software. For purpose of simplicity, the description of a processing device is used as singular; however, one skilled in the art will appreciated that a processing device may include multiple processing elements and multiple types of processing elements. For example, a processing device may include multiple processors or a processor and a controller. In addition, different processing configurations are possible, such a parallel processors.

The software may include a computer program, a piece of code, an instruction, or some combination thereof, to independently or collectively instruct and/or configure the processing device to operate as desired, thereby transforming the processing device into a special purpose processor. Software and/or data may be embodied permanently or temporarily in any type of machine, component, physical or virtual equipment, computer storage medium or device, or in a propagated signal wave capable of providing instructions or data to or being interpreted by the processing device. The software also may be distributed over network coupled computer systems so that the software is stored and executed in a distributed fashion. The software and data may be stored by one or more non-transitory computer readable recording mediums.

The methods according to the above-described embodiments may be recorded in non-transitory computer-readable media including program instructions to implement various operations of the above-described embodiments. The media may also include, alone or in combination with the program instructions, data files, data structures, and the like. The program instructions recorded on the media may be those specially designed and constructed for the purposes of embodiments, or they may be of the kind well-known and available to those having skill in the computer software arts. Examples of non-transitory computer-readable media include magnetic media such as hard disks, floppy disks, and magnetic tape; optical media such as CD-ROM discs, DVDs, and/or Blue-ray discs; magneto-optical media such as optical discs; and hardware devices that are specially configured to store and perform program instructions, such as read-only memory (ROM), random access memory (RAM), flash memory (e.g., USB flash drives, memory cards, memory sticks, etc.), and the like. Examples of program instructions include both machine code, such as produced by a compiler, and files containing higher level code that may be executed by the computer using an interpreter. The above-described devices may be configured to act as one or more software modules in order to perform the operations of the above-described embodiments, or vice versa.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

While this disclosure includes specific example embodiments, it will be apparent to one of ordinary skill in the art that various changes and modifications in form and details may be made in these example embodiments without departing from the spirit and scope of the claims and their equivalents. For example, suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A multichannel signal processing method performed by a processor of multichannel signal processing apparatus comprising:

identifying, by the processor, an N/2-channel downmix signal derived from an N-channel input signal; and generating, by the processor, an N-channel output signal from the identified N/2-channel downmix signal using a plurality of one-to-two (OTT) boxes implemented by a first program code performed in the processor, in response to the number of channels of the output signal exceeding a predetermined number of channels, decorrelators implemented by a second program code performed in the processor are reused, wherein N denoting the number of channels of the output signal is an even number more than 1.

2. The multichannel signal processing method of claim 1, wherein, if a low frequency effect (LFE) channel is absent in the output signal, a maximum number of N/2 decorrelators are used.

3. The multichannel signal processing method of claim 2, wherein an OTT box from which an LFE channel is output, each of the plurality of OTT boxes generates a 2-channel output signal using 1-channel downmix signal and CLD.

4. The multichannel signal processing method of claim 1, wherein the number of a plurality OTT boxes to be used for generating the N-channel output signal is equal to N/2.

5. The multichannel signal processing method of claim 1, wherein an OTT box from which an LFE channel is not output, generates a 2-channel output signal using residual signal, 1-channel downmix signal, CLD and ICC.

6. The multichannel signal processing method of claim 1, wherein the generating of the N-channel output signal includes generating the N-channel output signal using a pre-decorrelator matrix M1 and a mix matrix M2.

7. The multichannel signal processing method of claim 1, wherein each of the plurality of OTT boxes generates the N-channel output signal using a channel level difference (CLD).

8. A multichannel signal processing method performed by a processor of multichannel signal processing apparatus comprising:

decoding, by the processor, an N/2-channel downmix signal encoded based on a first coding scheme; and generating, by the processor, an N-channel output signal from the N/2-channel downmix signal based on a second coding scheme, in response to the number of channels of the output signal exceeding a predetermined number of channels, decorrelators implemented by a program code performed in the processor are reused, wherein N denoting the number of channels of the output signal is an even number more than 1.

9. A multichannel signal processing apparatus comprising a processor to implement a multichannel signal processing method, wherein the processor is configured to identify an N/2-channel downmix signal derived from an N-channel input signal, and generate an N-channel output signal from the identified N/2-channel downmix signal using a plurality of one-to-two (OTT) boxes implemented by a first program code performed in the processor, and in response to a low frequency effect (LFE) channel being absent in the output signal, a maximum number of N/2 decorrelators implemented by a second program code performed in the processor are used, wherein N denoting the number of channels of the output signal is an even number more than 1.

10. The multichannel signal processing method of claim 9, wherein the number of a plurality OTT boxes to be used for generating the N-channel output signal is equal to N/2.

11. The multichannel signal processing apparatus of claim 9, wherein an OTT box from which an LFE channel is not output generates a 2-channel output signal using residual signal, 1-channel downmix signal, CLD and ICC.

12. The multichannel signal processing apparatus of claim 9, wherein an OTT box from which an LFE channel is output, each of the plurality of OTT boxes generates a 2-channel output signal using 1-channel downmix signal and CLD.

13. The multichannel signal processing apparatus of claim 9, wherein the processor is configured to generate the N-channel output signal using a pre-decorrelator matrix) M1 and a mix matrix M2.

14. The multichannel signal processing apparatus of claim 9, wherein each of the plurality of OTT boxes generates the N-channel output signal using a channel level difference (CLD).

* * * * *